US006620579B2

(12) United States Patent
Nakai et al.

(10) Patent No.: US 6,620,579 B2
(45) **Date of Patent: *Sep. 16, 2003**

(54) PHOTOGRAPHIC PROCESSING COMPOSITION CONTAINING BIS-TRIAZINYLARYLENEDIAMINE DERIVATIVE AND DIAMINOSTILBENE DERIVATIVE, AND IMAGE-FORMATION PROCESS USING THE SAME

(75) Inventors: Yasufumi Nakai, Kangawa (JP); Makoto Suzuki, Kangawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/026,442

(22) Filed: Dec. 27, 2001

(65) Prior Publication Data

US 2002/0150846 A1 Oct. 17, 2002

(30) Foreign Application Priority Data

Dec. 27, 2000 (JP) ..... P.2000-398271

(51) Int. Cl.[7] ..... G03C 7/413
(52) U.S. Cl. ..... 430/486; 430/933
(58) Field of Search ..... 430/486, 933

(56) References Cited

U.S. PATENT DOCUMENTS

| | | | |
|---|---|---|---|
| 5,395,742 | A | 3/1995 | Deguchi et al. |
| 6,232,053 | B1 | 5/2001 | Goswami et al. |
| 2001/0031432 | A1 | 10/2001 | Nakai et al. |

OTHER PUBLICATIONS

Application Ser. No. 09/933,019 Aug. 21, 2001.*

Methods for Reducing Spectral Sensitizing Dye Stain in Photographic Elements, Research Disclosure No. 20733, p. 268, Jul. 1981.

* cited by examiner

*Primary Examiner*—Hoa Van Le
(74) *Attorney, Agent, or Firm*—Sughrue Mion, PLLC

(57) ABSTRACT

The present invention provides a processing composition for a silver halide color photographic photosensitive material. The processing composition has excellent functions of reducing stain caused by residual dyes in a photosensitive material and of making no segregated deposit even in low temperature storage of the processing composition. The processing composition of the invention contains a bis-triazinylarylenediamine derivative and a diaminostilbene derivative. The invention also provides an image-formation process using the processing composition of the invention.

4 Claims, No Drawings

PHOTOGRAPHIC PROCESSING COMPOSITION CONTAINING BIS-TRIAZINYLARYLENEDIAMINE DERIVATIVE AND DIAMINOSTILBENE DERIVATIVE, AND IMAGE-FORMATION PROCESS USING THE SAME

FIELD OF THE INVENTION

The present invention relates to a processing composition for a silver halide color photographic photosensitive material. In particular, the invention relates to a composition having excellent functions of reducing stain caused by residual dyes in a photosensitive material and of making no segregated deposit in low temperature storage of the processing composition.

BACKGROUND OF THE INVENTION

In the drastic progress of digital cameras as well as color printers, it has been desired that high quality images would rapidly be provided for customers in processing of color photographic photosensitive materials. However, when conventional processing processes had been conducted in a simply shortened time, the resulted image became colored to a level of objection with a large amount of sensitizing dyes remained in a white part of color print. Because of the simply shortened time of processing, sensitizing dyes in a photosensitive material were not enough washed out until processing had been completed. Also in case of a color negative film, such a situation occurred that production of the proper prints became impossible because of deterioration of color balance due to density increase at the minimum density area.

Further in recent years, tabular grains of silver halide as an important fundamental technique have been used in a highly photosensitive material for taking photographs. This technique gives effects of improving photosensitivity and a ratio between photosensitivity and graininess, since an amount of sensitizing dye used in a unit of volume can be increased. On the other hand, the technique gives an increase of dye amount remained in the photosensitive material after processing. In some processing conditions, the increase of residual amount of sensitizing dye can not be neglected but it results in phenomena that a density at the minimum density area of color negative film increases and that a highlight area of color reversal film is stained.

*Research Disclosure* No. 20733 discloses a method using a bis-triazinylaminostilbene disulfonic acid compound as an example of a method for removing residual colors caused by sensitizing dyes. This method has widely been used in processing of color photographic photosensitive materials. Japanese Patent Laid-Open No. 329936/1994 discloses bis-triazinylaminostilbene disulfonic acid compounds having excellent solubility and being able to reduce residual colors even after time-shortened processing.

However, further condensation of a processing composition has been desired due to reasons of reducing waste containers, improving ability for recycling and reducing cost of transportation and storage. Any compound that dissolves in a stable state even under a high salt concentration by condensation and shows sufficient effects when used at its solubility or less even in a time-shortened processing has not been found yet.

SUMMARY OF THE INVENTION

The purpose of the present invention is to provide a processing composition for a silver halide color photographic photosensitive material for achieving reduction of stain caused by sensitizing dyes remained in a photosensitive material after processing and for making no segregated deposit even in low temperature-storage of the processing composition.

The problems described in the above were solved by the following invention.

1. A processing composition for a silver halide photographic photosensitive material, comprising a compound represented by Formula (I) described below and a compound represented by Formula (II) described below.

Formula (I)

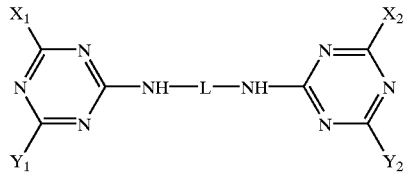

In Formula (I), $X_1$, $X_2$, $Y_1$ and $Y_2$ each independently represent an alkoxy group, an aryloxy group, an anilino group, an alkylamino group, a dialkylamino group or a nitrogen-containing heterocyclic group, a hydroxyl group, an amino group and a chloro group, which may be substituted. L represents a substituted or unsubstituted phenylene group or a substituted or unsubstituted naphthylene group.

Formula (II)

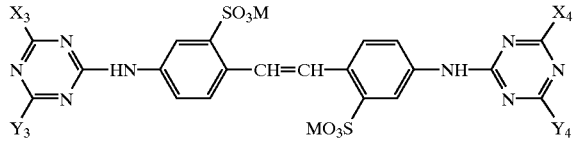

In Formula (II), $X_3$, $X_4$, $Y_3$ and $Y_4$ each independently represent an alkoxy group, an aryloxy group, an anilino group, an alkylamino group, a dialkylamino group or a heterocyclic group, a hydroxyl group, an amino group and a chloro group, which may be substituted. M represents a hydrogen atom, an alkali metal; an alkali-earth metal, ammonium or pyridinium.

2. The processing composition for a silver halide photographic photosensitive material as described in the foregoing 1 to be used in color development processing.
3. The processing composition for a silver halide photographic photosensitive material as described in the foregoing 1 or 2 to be used in processing of a silver halide color print photosensitive material.
4. An image-forming process using the processing composition for a silver halide photographic photosensitive material as described in any one of the foregoing 1 to 3.

The compound represented by Formula (I) of the invention gives no fluorescence and the compound represented by Formula (II) has fluorescent whitening function. By using these compounds together in processing of color print materials, it has become possible independently to control fluorescent whitening function and reduction of stain caused by sensitizing dyes. Accordingly, it has become possible to obtain compatibility between fluorescent whitening and reduction of stain, since stain can be reduced without density lowering in a shadow area and gradation softening due to excessive use of a fluorescent whitening agent. Further, by using both of the compound represented by Formula (I) and the compound represented by Formula (II) in combination, it has been found that each solubility of these compounds increases to make preparation of a more condensed processing composition possible. It has also been found that other components in the processing solution increase their solubility, and particularly, a developing agent increases its solubility.

DETAILED DESCRIPTION OF THE INVENTION

Formula (I) will be explained in detail hereinafter. When $X_1$, $X_2$, $Y_1$, and $Y_2$ each represent an alkoxy group, an aryloxy group, an anilino group, an alkylamino group and a dialkylamino group, which may be substituted, these are expressed by Formula (III) as described below. Formula (III):

$$—O—R_1 \quad —NHR_2 \quad —NK_2R_3$$

In Formula (III), $R_1$, $R_2$ and $R_3$ are a substituted or unsubstituted alkyl group, or a substituted or unsubstituted aryl group. When a group represented by $R_1$, $R_2$, or $R_3$ is an alkyl group, the alkyl group is a substituted or unsubstituted alkyl group having 1 to 20 carbon atoms, preferably 1 to 8, and more preferably 1 to 4. Examples of the alkyl group include a methyl group, an ethyl group, an i-propyl group, a n-propyl group, a n-octyl group, a sulfomethyl group, a 2-hydroxyethyl group, a 3-hydroxypropyl group, a 2-hydroxypropyl group, a 2-sulfoethyl group, a 2-methoxyethyl group, a 2-(2-hydroxyethoxy)ethyl group, a 2-[2-(2-hydroxyethoxy)ethoxy] ethyl group, a 2-{2-[2-(2-hydroxyethoxy)ethoxy]ethoxy} ethyl group, a 2, 3-dihydroxypropyl group, a 3,4-dihydroxybutyl group and a 2,3,4,5,6-pentahydroxyhexyl group.

When $R_1$, $R_2$ and $R_3$ represent an aryl group, the aryl group is a substituted or unsubstituted aryl group having 6 to 20 carbon atoms, preferably 6 to 10, and more preferably 6 to 8. Examples of the aryl group include a phenyl group, a naphthyl group, a 3-carboxyphenyl group, a 4-carboxyphenyl group, a 3,5-dicarboxyphenyl group, a 4-methoxyphenyl group, a 2-sulfophenyl group, a 4-sulfophenyl group and a 2,4-disulfophenyl group.

When $R_1$, $R_2$ and $R_3$ have a carboxyl group or a sulfo group, these groups may be a free body or a salt. In this case, a counter ion is an alkali metal, an alkali-earth metal, ammonium or pyridinium. Among them, sodium and potassium are most preferred.

$X_1$, $X_2$, $Y_1$ and $Y_2$ may be a one-valent (monovalent) 5- or 6-membered ring group in which a hydrogen atom bonding to a nitrogen atom is removed from a 5- or 6-membered aromatic or non-aromatic nitrogen-containing heterocyclic compound. Examples of the ring include a pyrrolidine ring, a piperidine ring, a piperazine ring and a morpholine ring, which may be substituted.

Otherwise, $X_1$, $X_2$, $Y_1$ and $Y_2$ may be an amino acid residue in which a hydrogen atom of an amino group is removed and the amino group forms a linking group, or may be a hydroxy organic acid residue in which a hydrogen atom of a hydroxyl group is removed and the hydroxyl group forms a linking group.

A phenylene group or a naphthylene group represented by L is a substituted or unsubstituted phenylene or naphthylene group having 6 to 20 carbon atoms, preferably 6 to 15, and more preferably 6 to 11. Examples of the substituted or unsubstituted phenylene or naphthylene group include a 1,4-phenylene group, a 1,3-phenylene group, a 1,2-phenylene group, a 1,5-naphthylene group, a 1,8-naphthylene group, a 4-carboxy-1,2-phenylene group, a 5-carboxy-1,3-phenylene group, a 3-sulfo-1,4-phenylene group, a 5-sulfo-1,3-phenylene group, a 2,5-dimethoxy-1,4-phenylene group and a 2,6-dichloro-1,4-phenylene group.

L is preferably a 1,4-phenylene group, a 1,3-phenylene group, a 1,2-phenylene group, a 1,5-naphthylene group and a 5-carboxy-1,3-phenylene group, and more preferably a 1,4-phenylene group and a 1,3-phenylene group.

Specific compounds represented by Formula (I) will be indicated hereinafer. However, compounds involved in the present invention should not be construed as being limited thereto.

P-1

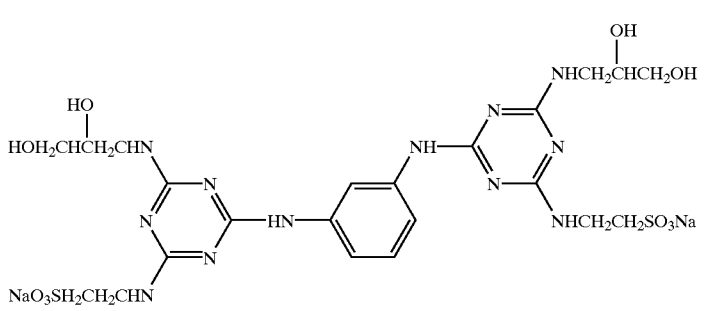

P-2

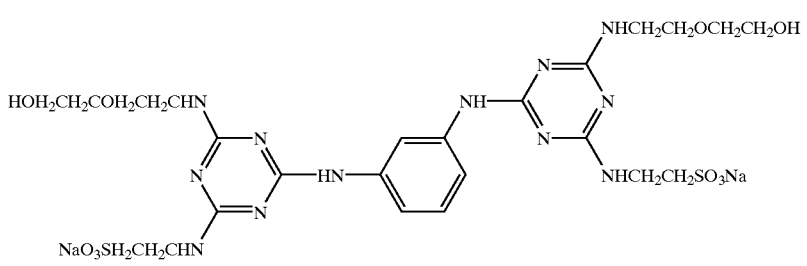

-continued
P-3
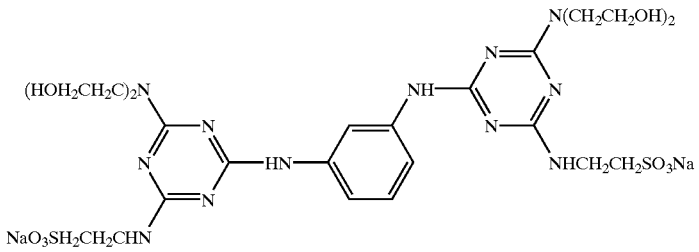
P-4
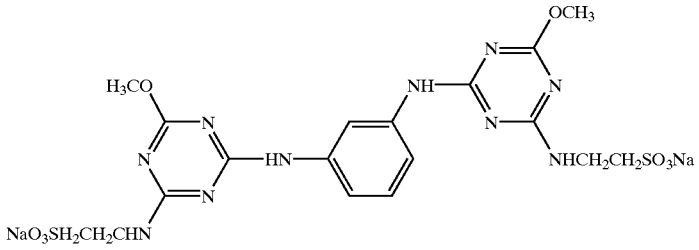
P-5
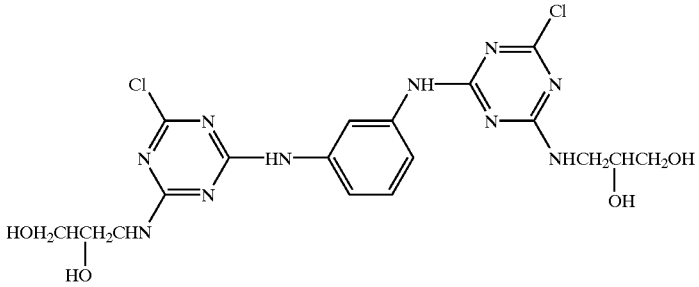
P-6
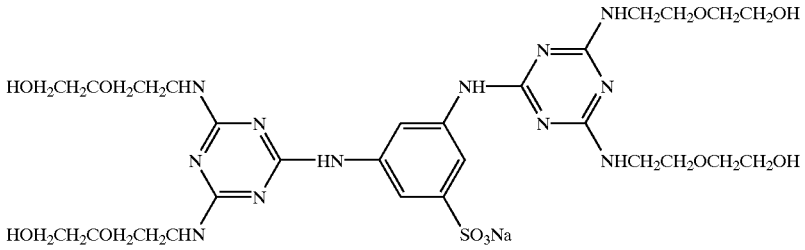
P-7
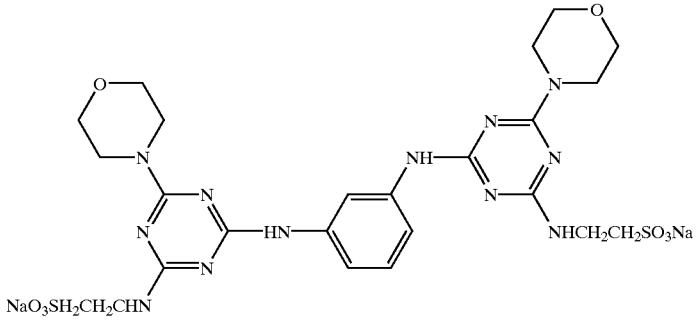

-continued
P-8
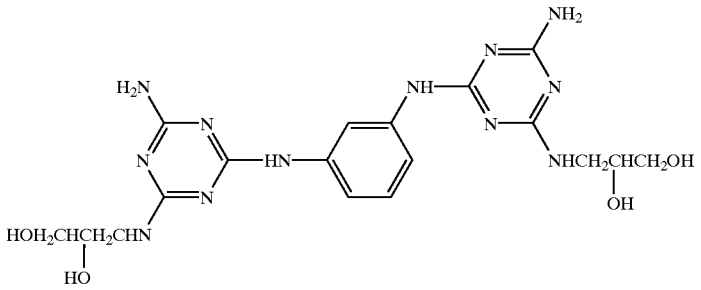
P-9
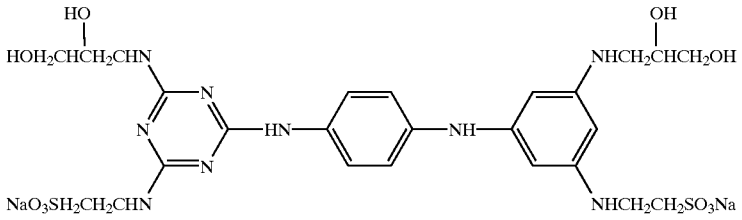
P-10
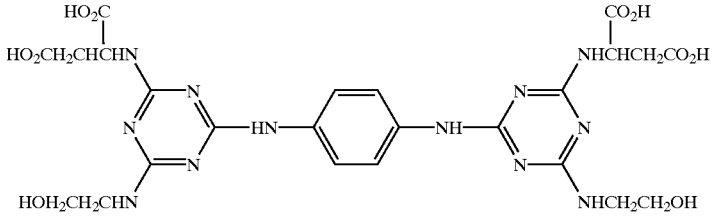
P-11
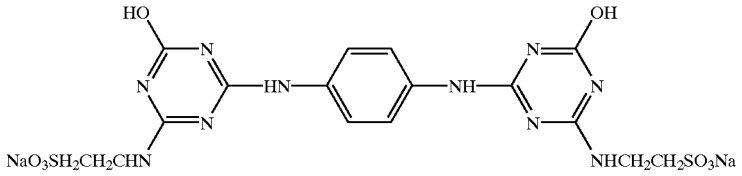
P-12
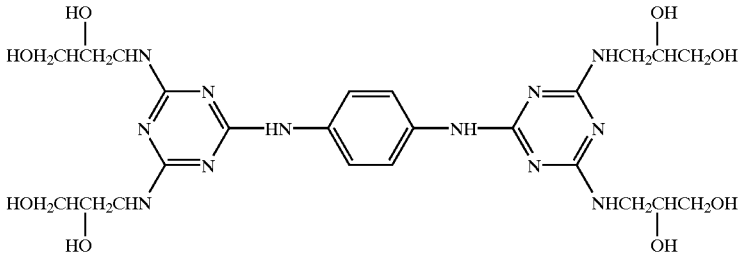
P-13
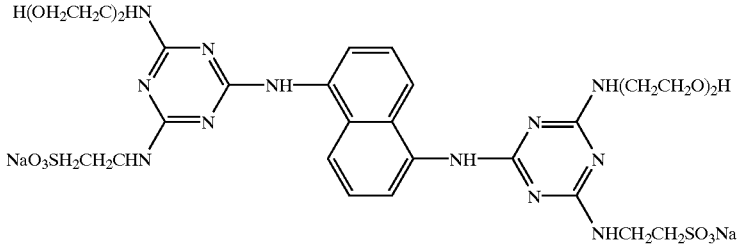

-continued
P-14
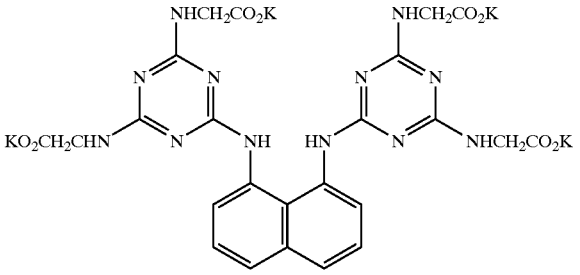
P-15
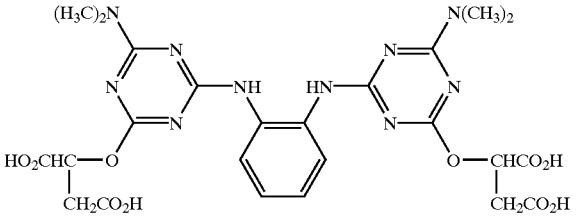
P-16
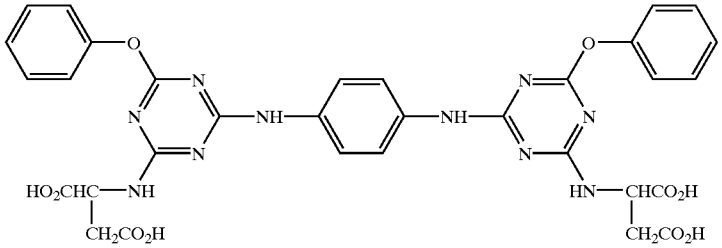
P-17
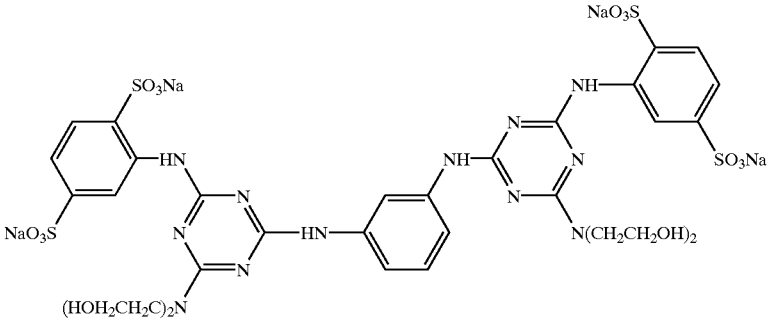
P-18
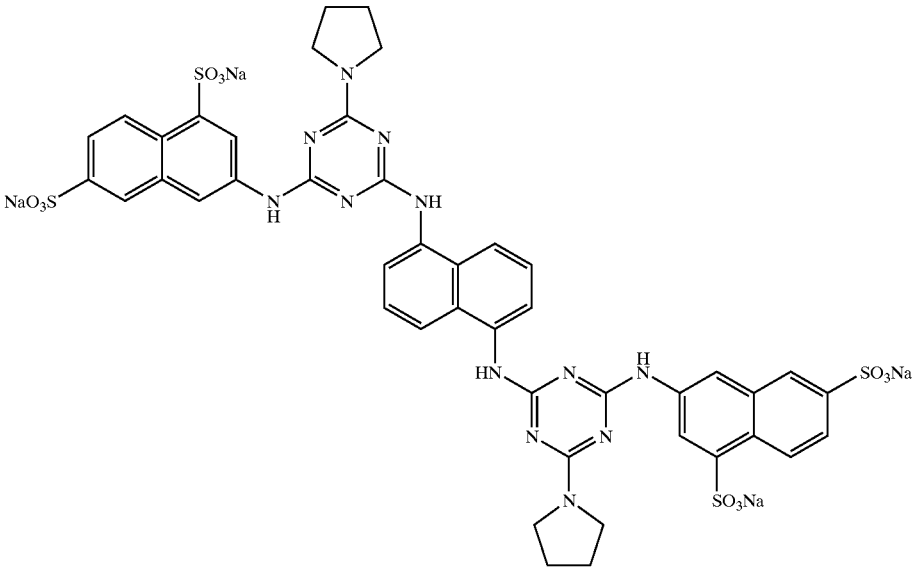

-continued

P-19

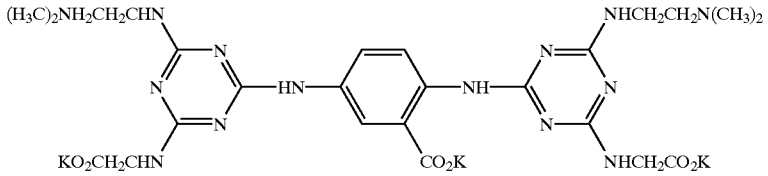

P-20

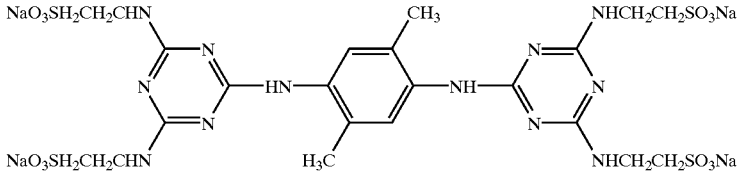

Formula (II) will be explained in detail hereinafter.

When $X_3$, $X_4$, $Y_3$ and $Y_4$ each represent an alkoxy group, an aryloxy group, an anilino group, an alkylamino group and a dialkylamino group, which may be substituted, these are expressed by Formula (IV) as described below. Formula (IV):

$$—O—R_4 \quad —NHR_5 \quad —NR_5R_6$$

In Formula (IV), $R_4$, $R_5$ and $R_6$ represent an alkyl group, or an aryl group. When a group represented by $R_4$, $R_5$ or $R_6$ is an alkyl group, the alkyl group is a substituted or unsubstituted alkyl group having 1 to 20 carbon atoms, preferably 1 to 8, and more preferably 1 to 4. Examples of the alkyl group include a methyl group, an ethyl group, an i-propyl group, a n-propyl group, a n-octyl group, a sulfomethyl group, a 2-hydroxyethyl group, a 3-hydroxypropyl group, a 2-hydroxypropyl group, a 2-sulfoethyl group, a 2-methoxyethyl group, a 2-(2-hydroxyethoxy)ethyl group, a 2-[2-(2-hydroxyethoxy)ethoxy] ethyl group, a 2-{2-[2-(2-hydroxyethoxy)ethoxy]ethoxy} ethyl group, a 2,3-dihydroxypropyl group, a 3,4-dihydroxybutyl group and a 2,3,4,5,6-pentahydroxyhexyl group.

When $R_4$, $R_5$ and $R_6$ represent an aryl group, the aryl group is a substituted or unsubstituted aryl group having 6 to 20 carbon atoms, preferably 6 to 10, and more preferably 6 to 8. Examples of the aryl group include a phenyl group, a naphthyl group, a 3-carboxyphenyl group, a 4-carboxyphenyl group, a 3,5-dicarboxyphenyl group, a 4-methoxyphenyl group, a 2-sulfophenyl group, a 4-sulfophenyl group and a 2,4-disulfophenyl group.

$X_3$, $X_4$, $Y_3$ and $Y_4$ may be a one-valent 5- or 6-membered ring group in which a hydrogen atom bonding to a nitrogen atom is removed from a 5- or 6-membered aromatic or non-aromatic nitrogen-containing heterocyclic compound. Examples of the ring include a pyrrolidine ring, a piperidine ring, a piperazine ring and a morpholine ring, which may be substituted.

Otherwise, $X_3$, $X_4$, $Y_3$ and $Y_4$ may be an amino acid group in which a hydrogen atom of an amino group is removed to make a connection or a hydroxy organic acid group in which a hydrogen atom of a hydroxyl group is removed to make a connection.

Among alkali metals and alkali-earth metals represented by M, sodium and potassium are particularly preferable. As an ammonium group, ammonium, triethylammonium and tetrabutylammonium are mentioned.

Specific compounds represented by Formula (IV) will be indicated below. However, compounds involved in the invention are not construed as being limited thereto.

S-1

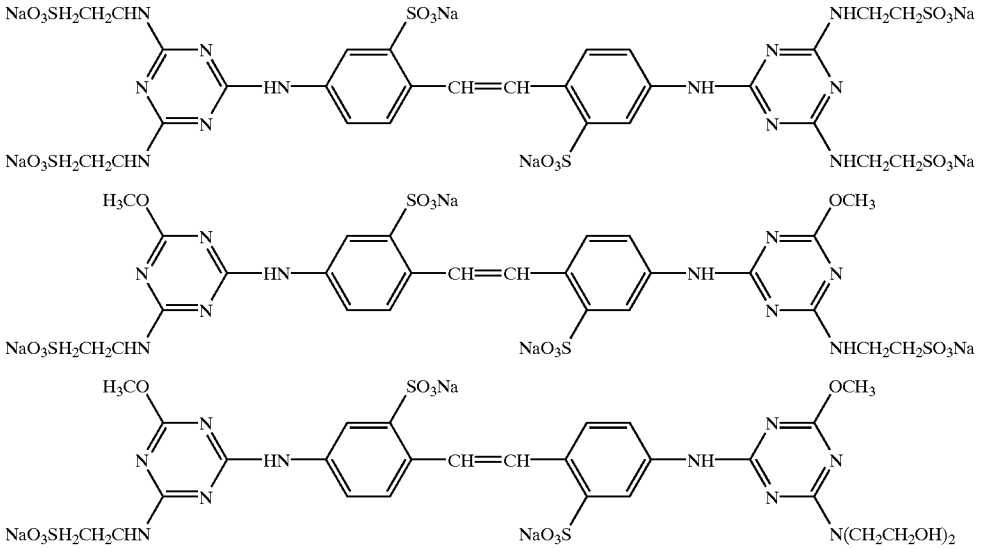

-continued
S-2
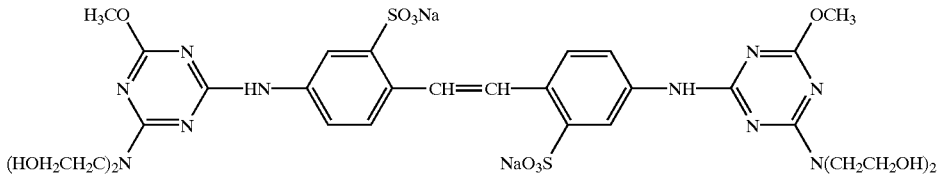
(a mixture of the above three components)
S-3
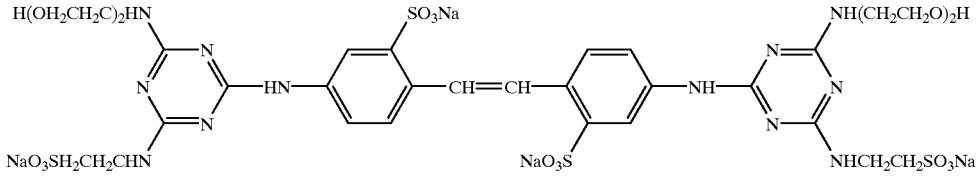
S-4
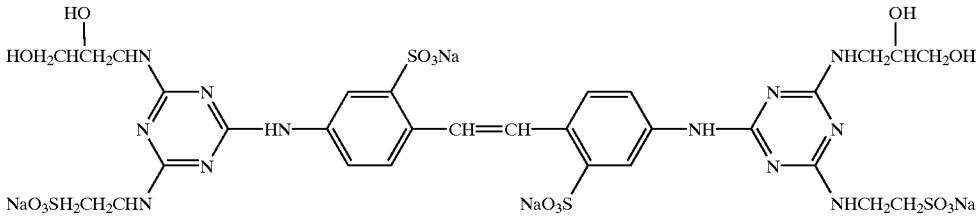
S-5
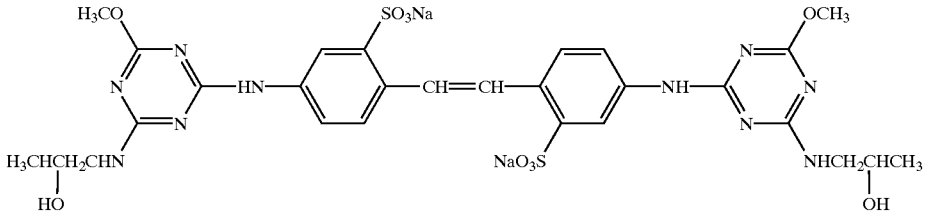
S-6
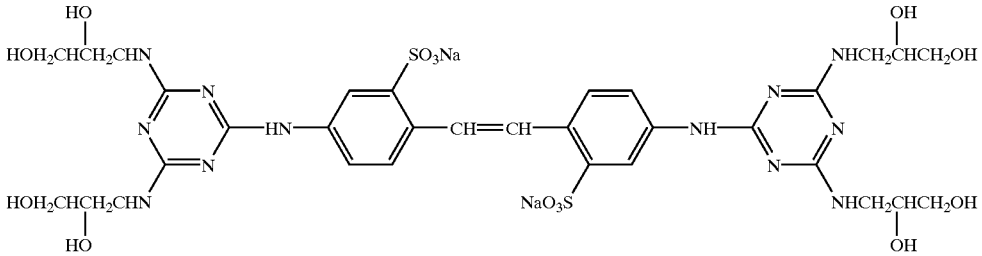
S-7
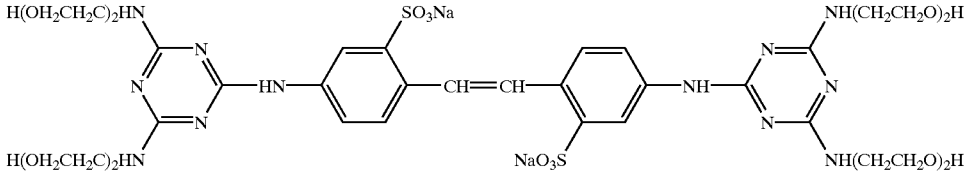
S-8
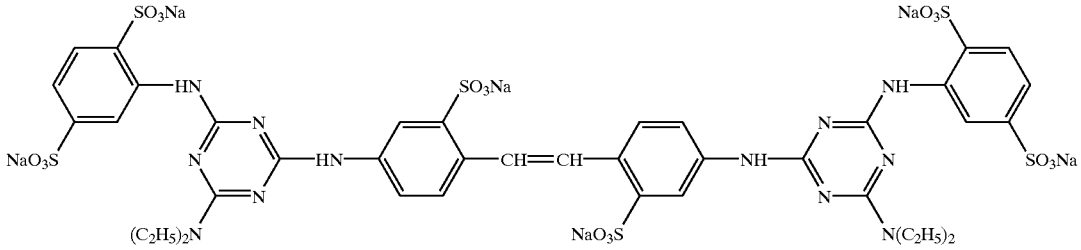

-continued
S-9
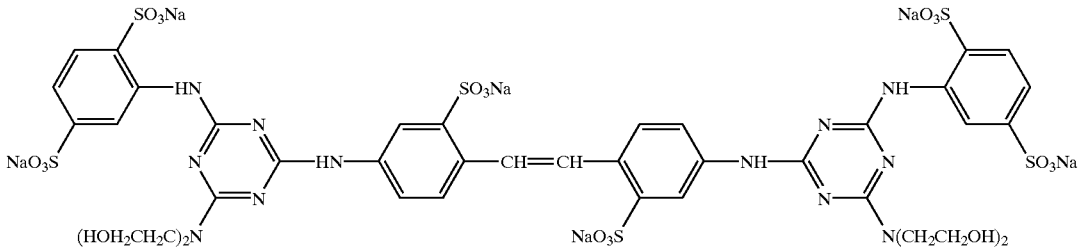
S-10
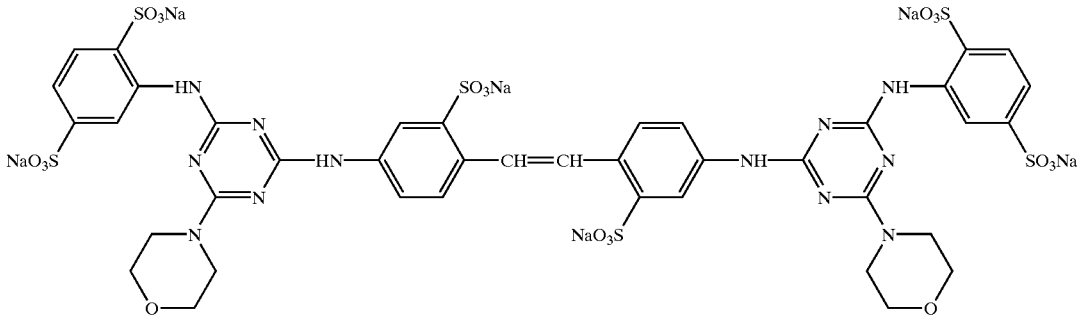
S-11
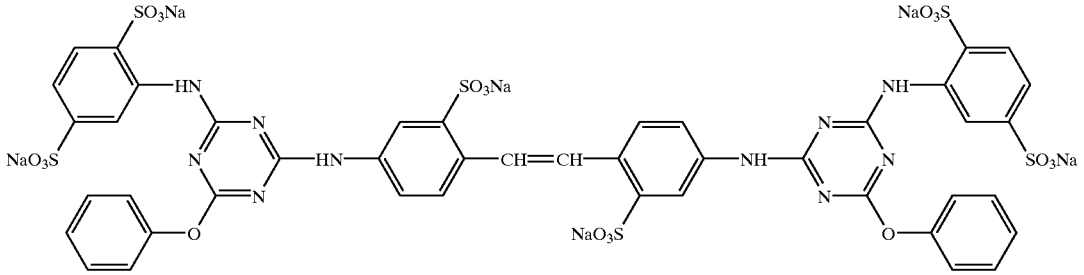
S-12
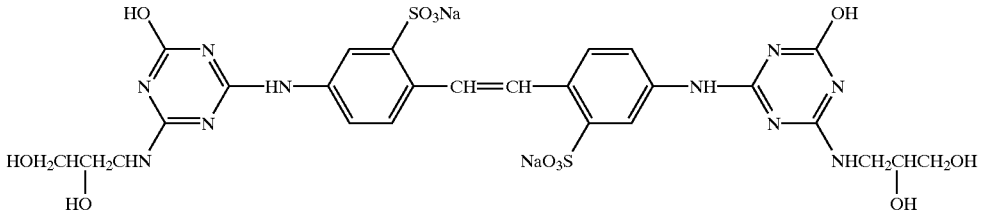
S-13
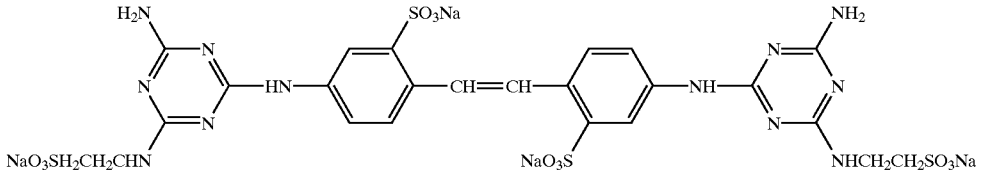
S-14
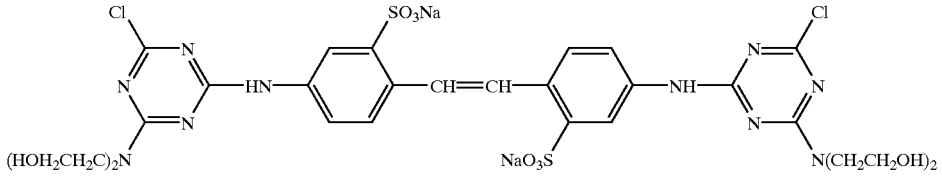

-continued

S-15

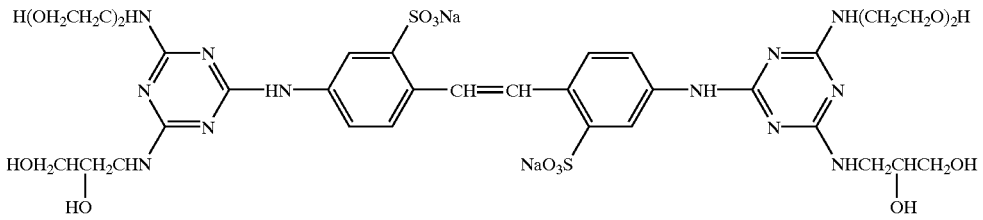

S-16

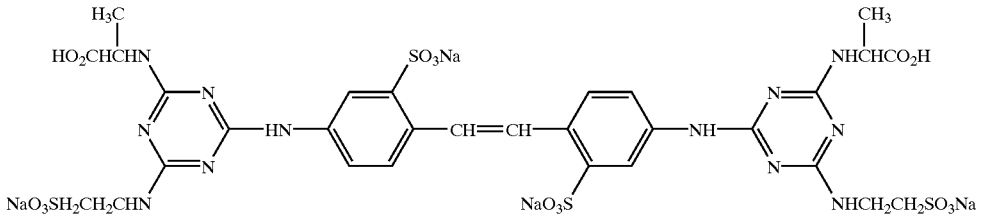

In case that a compound represented by Formula (I) and a compound represented by Formula (II) of the invention contain a plurality of asymmetric carbon atoms in the molecule, there exist a plurality of stereoisomers for the same structure. The invention involves all the possible stereoisomers. These stereoisomers can be used as a single kind or some kinds of them in combination.

Compounds represented by Formula (I) and compounds represented by Formula (II) of the invention can be used as a single kind or as plural kinds in combination. The number of compounds to be used and the sort of processing composition in which these compounds are contained can optionally be selected.

The processing composition of the invention will be explained in detail hereinafter. In the invention, the processing composition means a processing composition necessary for processing to perform image-formation of a silver halide color photographic photosensitive material. Specifically, a color development composition, a bleach composition, a blix (bleach and fix) composition, a fix composition, a washing composition and a stabilization composition are mentioned as the processing composition. Further, a black-and-white development composition, a reversal composition and a pre-bleach composition may be mentioned. Each processing composition described in the above also involves prepared processing agent compositions to be mixed. The processing composition of the invention is preferably a color development composition and a black-and-white development composition, and particularly a color development composition. Above all, the effects of the invention are effectively revealed when the processing composition of the invention is applied to a color development composition for a color print material. These processing compositions may be prepared as a tank solution or a replenishing solution in either concentration of a use solution or of a condensed solution. When the processing composition of the invention is a condensed solution, it is used as a replenishing solution or as a tank solution after being mixed with water at a ratio determined for the use. The compounds of the invention are characterized in that the composition in a solution state has excellent stability against segregation, therefore, the effects of the invention are remarkable in case of a single solution or in case of prepared processing agent compositions in a condensed solution form to be mixed. However, the compounds of the invention may be used in each of processing agent compositions in a granular form, a tablet form, a powder form or a slurry form.

Further, the composition of the invention may be an additive composition. The additive composition means a composition having functions of controlling photographic properties by adding into a tank solution or a replenishing solution to be needed for processing to perform image-formation of a silver halide color photographic photosensitive material.

In the processing composition of the invention, each of concentrations of the compounds represented by Formula (I) and Formula (II) is in the range from 0.05 mmol/L to 20 mmol/L in the state of a use solution, preferably from 0.15 mmol/L to 15 mmol/L, and more preferably from 0.2 mmol/L to 10 mmol/L. The molar ratio of the compound of Formula (I) to the compound of Formula (II) is generally 1:10 to 10:1, preferably 1:5 to 5:1, more preferably 1:3 to 3:1. Besides, in case that the processing composition or the invention is used after being diluted with water or with other processing composition, the concentration of the processing composition takes a value made of the concentration of the use solution multiplied by the condensation ratio.

The image-formation process of the invention employs the processing composition of the invention in at least one of processing processes. The processing composition of the invention may be used in a plurality of processes or in all the processes.

There are some methods as a manufacture method of the processing composition of the invention. The following three methods give good results. However, in the execution of the invention, the manufacture method should not be construed as being limited to the following three methods.

[Method A] A method in which a little quantity of water is preliminary introduced into a mixing tank, and then chemicals of the composition are added in order respectively into the tank while being stirred.

[Method B] A method in which chemicals of the composition are preliminary mixed in a mixing tank, and then a little quantity of water is added at once into the tank.

[Method C] A method in which chemicals of the composition are preliminary divided into adequate numbers of groups, each group is dissolved in water or in a hydrophilic organic solvent to be a concentrated solution, and then concentrated solutions are mixed together.

Further, a manufacture method in which each method is partly involved can be conducted.

Regarding the case where the processing composition of the invention is a development composition, a bleach composition, a blix composition, a fix composition, a washing composition and a stabilizing composition or an additive composition, each composition will be explained hereinafter.

The color development composition of the invention contains a color developing agent. For the color developing agent, known aromatic primary amine color developing agents are preferable, and particularly p-phenylenediamine derivatives are preferable. Typical examples will be indicated hereinafter. However, the invention should not be construed as being limited thereto. Further these years, among black-and white photosensitive materials, there are some materials in which couplers are added to develop black color for forming a black-and-white image even by using a color developing solution for general use. The processing composition of the invention can be applied to such a kind of photosensitive material.

1) N, N-diethyl-p-phenylenediamine
2) 4-amino-N, N-diethyl-3-methylaniline
3) 4-amino-N-(β-hydroxyethyl)-N-methylaniline
4) 4-amino-N-ethyl-N-(β-hydroxyethyl)aniline
5) 4-amino-3-methyl-N-ethyl-N-(β-hydroxyethyl)aniline
6) 4-amino-3-methyl-N-ethyl-N-(3-hydroxypropyl)aniline
7) 4-amino-3-methyl-N-ethyl-N-(4-hydroxybutyl)aniline
8) 4-amino-N-ethyl-N-(β-methanesulfonamide ethyl)-3-methylaniline
9) 4-amino-N, N-diethyl-3-(β-hydroxyethyl)aniline
10) 4-amino-3-methyl-N-ethyl-N-(β-methoxyethyl)aniline
11) 4-amino-3-methyl-N-(β-ethoxyethyl)-N-ethylaniline
14) 4-amino-3-methyl-N-(3-carbamoylpropyl)-N-n-propylaniline
13) 4-amino-3-methyl-N-(4-carbamoylbutyl)-N-n-propylaniline
14) N-(4-amino-3-methylphenyl)-3-hydroxypyrrolidine
15) N-(4-amino-3-methylphenyl)-3-hydroxymethylpyrrolidine
16) N-(4-amino-3-methylphenyl)-3-pyrrolidinecarboxyamide Among the p-phenylenediamine derivatives indicated in the above, compounds illustrated in 5), 6), 7), 8) and 12) are preferable, and compounds illustrated in 5) and 8) are particularly preferable. These p-phenylenediamine derivatives are, usually in a solid state, a sulfate, a chlorate, a p-toluene sulfonate, a naphthalene disulfonate and a salt of N, N-bis(sulfonic acid ethyl) hydroxylamine. These derivatives may be added as a free body without a counter salt. A concentration of the aromatic primary amine developing agent in a use solution is in the range from 4 mmol/L to 100 mmol/L, preferably from 6 mmol/L to 50 mmol/L, and more preferably from 8 mmol/L to 25 mmol/L.

To the color developing solution of the invention, a compound for preventing segregation of a color developing agent may be added. For such a compound, polyethylene glycols, aryl sulfonic acids, alkyl sulfonic acids or urea compounds described in Japanese Patent Laid-Open No. 174643/1999 are mentioned. Among these, diethylene glycol, polyethylene glycol 300, p-toluene sulfonic acid and its salt, an alkyl sulfonic acid having a straight chain with 5 to 9 carbon atoms and its salt and ethylene urea, which show good effects but very little influence to photographic properties, are particularly preferred.

The color development composition of the invention preferably contains a compound for preventing deterioration caused by aerial oxidation of a color developing agent, namely, a preservative. As inorganic preservatives, a sulfite and hydroxylamine are preferable. These compounds give a remarkable preservation action. Further, it is preferable that such an inorganic compound is used with an organic preservative in combination. In some cases dependent on a photosensitive material taken as an object, a sulfite and hydroxylamine may give unfavorable influences to photographic properties in a color development process. Therefore, there may be a case that only one of the two compounds is incorporated, or a case that none of them is substantially incorporated but an organic preservative solely used.

Preferable organic preservatives are hydroxylamine derivatives, hydroxamic acids, hydrazides, phenols, monoamines, diamines, polyamines, alcohols, condensed ring-based amines, ring-based amides, salicylic acids, polyethylene imines, alkanol amines, aromatic polyhydroxy compounds, hydroxylamine derivatives described in Japanese Patent Laid-Open No. 56456/1991 and compounds described in Japanese Patent Laid-Open Nos. 33846/1991 and 148841/1994.

In viewpoint of improving stability of the color developing solution in a continuous processing, it is preferred that a hydroxylamine derivative is used with alkanol amines in combination. As a particularly preferable compound used with hydroxylamines in combination, tri-isopropanol amine and tri-ethanol amine are mentioned. Further, it is also preferred that a hydroxylamine derivative is used with ring-based amide compounds in combination. Among them, ε-caprolactum is particularly preferred.

A pH value of the color development composition of the invention is preferably in the range from 9.5 to 13.5. A pH value of the color developing solution prepared from the color development composition of the invention is in the range from 9.0 to 12.2, and preferably from 9.9 to 11.2. In order to maintain the pH value, a buffer agent is preferably added. For a buffer agent, preferred is a potassium salt or a sodium salt of an inorganic acid such as a carbonate, a bicarbonate, a phosphate, a borate and a tetraborate. Further, an organic compound such as 5-sulfosalicylic acid, β-alanine, proline and tris-hydroxyaminomethane is also preferably used. However, the present invention should not be construed as being limited thereto. The buffer agent is incorporated in a color development replenisher to become a concentration of 0.1 mol/L or more, and particularly in the range from 0.1 mol/L to 0.4 mol/L.

To the color development composition of the invention, various kinds of chelating agents, which are precipitation-preventing agents against magnesium and the like, can be added. A single kind or two or more kinds of chelating agents may be used. Examples of the preferable chelating compound include nitrilo triacetic acid, diethylenetriamine penta-acetic acid, ethylenediamine tetra-acetic acid, N, N, N-trimethylenephosphonic acid, ethylenediamine-N, N, N', N'-tetramethylenesulfonic acid, ethylenediamine succinic acid (an s, s body), 2-phosphonobutane-1,2,4-tricarboxylic acid, 1-hydroxyethylidene-1,1-diphosphonic acid and 1,2-dihydroxybenzene-4,6-disulfonic acid. The chelating agent may be added in an amount enough to cover metallic ions in a color developing solution. An amount of the chelating agent to be added usually in the range from 0.1 g/L to 10 g/L.

To the color development composition of the invention, an optional development-accelerator can be added according to necessity. Examples of the development-accelerator include polyalkyleneoxide, 1-phenyl-3-pyrazolidones, alcohols and carboxylic acids.

To the color development composition of the invention, an optional anti-foggant can be added according to necessity, As the anti-foggant, metal halides such as sodium chloride, potassium bromide and potassium iodide and organic anti-foggants typical ones of which are nitrogen-containing heterocyclic compounds are mentioned. Examples of the organic anti-foggant include benzotriazole, 6-nitrobenzimidazole, 5-nitroisoindazole, 5-methylbenzotriazole, 5-nitrobenzotriazole, 5-chlorobenzotriazole, 2-thiazolylbenzimidazole, 2-thiazolylmethylbenzimidazole, indazole, hydroxyazaindolidine and adenine. Further, other alkylcarboxylic acids, arylcarboxylic acids and sugars may be added according to necessity.

In case of a color print photosensitive material in the color development to which the invention is applied, a processing temperature is in the range from 30° C. to 55° C., preferably from 35° C. to 50° C., and more preferably from 38° C. to 45° C. A processing time is in the range from 5 seconds to 90 seconds, preferably from 8 seconds to 60 seconds, and more preferably from 10 seconds to 45 seconds. Although the less amount of replenishing is the better, an amount of replenishing in the range from 15 mL to 200 mL per 1 $m^2$ of the photosensitive material is adequate, preferably from 20 mL to 120 mL, and more preferably from 30 mL to 60 mL.

In case of a color negative film, a processing temperature is in the range from 30° C. to 55° C., preferably from 35° C. to 50° C., and more preferably from 38° C. to 45° C. A processing time is in the range from 45 seconds to 5 minutes, preferably from 60 seconds to 4 minutes, and more preferably from 90 seconds to 3 minutes and 15 seconds. Although the less amount of replenishing is the better, an amount of replenishing in the range from 10 mL to 200 mL per 1 roll for 24 exposures is adequate, preferably from 12 mL to 60 mL, and more preferably from 15 mL to 30 mL.

In case of a color reversal film, a processing temperature is in the range from 32° C. to 45° C., preferably from 35° C. to 40° C., and more preferably from 36.5° C. to 39.5° C. A processing time is in the range from 4 minutes to 8 minutes, preferably from 5 minutes to 7 minutes, and more preferably from 5 minutes and 30 seconds to 6 minutes and 30 seconds. Although the less amount of replenishing is the better, an amount of replenishing in the range from 1000 mL to 3000 mL per 1 $m^2$ of the photosensitive material is adequate, preferably from 1500 mL to 2800 mL, and more preferably from 2000 mL to 2400 mL.

Examples of the preferable mode include color development compositions condensed from replenishing solutions described in Japanese Patent Laid-Open Nos. 174643/1999, 194461/1999 and 194462/1999.

For a bleaching agent to be used in the bleach composition and the blix composition of the invention, known bleaching agents can be used. Particularly preferable are organic complex salts of iron (III) (e.g., complex salts of organic acids such as aminopolycarboxylic acids or citric acid, tartaric acid and malic acid), a persultate and hydrogen peroxide. Further, two or more kinds of bleaching agents may be used as a mixture.

Among these, organic complex salts of iron (III) are particularly preferable in viewpoint of rapid processing and prevention of environmental pollution. Aminopolycarboxylic acids or their salts, which are useful to form organic complex salts of iron (III), can be enumerated as follows: from biodegradable compounds such as ethylenediamine succinic acid (an s, s-body), N-(2-carboxylatethyl)-L-aspartic acid, β-alanine diacetic acid and methylimino diacetic acid to ethylenediamine tetra (acetic acid), diethylenetriamine penta (acetic acid), 1,3-propylenediamine tetra (acetic acid), nitrilo triacetic acid, cyclohexanediamine tetra-acetic acid and imino diacetic acid. These compounds may be any salt of sodium, potassium, lithium or ammonium. Further, the chelating agent may be used in excess over the amount needed to form a ferric complex salt. A concentration of the bleaching agent in the bleach solution or the blix solution as a use solution is in the range from 0.01 mol/L to 1.0 mol/L, preferably from 0.05 mol/L to 0.5 mol/L, and more preferably from 0.1 mol/L to 0.5 mol/L.

It is also preferable to add the buffer agent into the bleach solution or the blix solution. The buffer agent is selected in accordance with the pH value to achieve. Preferable compounds are mentioned as follows: organic acids such as succinic acid, maleic acid, glycolic acid, malonic acid, fumaric acid, sulfosuccinic acid and acetic acid, organic bases such as imidazole and dimethylimidazole, or compounds represented by Formula (A-a) and Formula (B-b) described in Japanese Patent Laid-Open No. 211819/1997. An addition amount of these compounds in a use solution is preferably in the range from 0.005 mol/L to 3.0 mol/L, and more preferably from 0.05 mol/L to 1.5 mol/L. A pH range of the bleach solution is preferably from pH 2 to pH 7, and in particular, preferably from pH 3 to pH 6. In case of the blix solution, the range from pH 3 to pH 8 is preferable, and the range from pH 4 to pH 7 is more preferable.

In the blix process of a color print photosensitive material, to which the invention is applied, a processing temperature is in the range from 30° C. to 55° C., preferably from 35° C. to 50° C., and more preferably from 38° C. to 45° C. A blix time is in the range from 5 seconds to 90 seconds, preferably from 8 seconds to 60 seconds, and more preferably from 10 seconds to 45 seconds. Although the less amount of replenishing is the better, an amount of replenishing in the range from 20 mL to 200 mL per 1 $m^2$ of the photosensitive material is adequate, preferably from 25 mL to 120 mL, and more preferably from 30 mL to 50 mL.

In the blix process of a color negative film, a processing temperature is in the range from 30° C. to 55° C., preferably from 35° C. to 50° C., and more preferably from 38° C. to 45° C. A blix time is in the range from 12 seconds to 2 minutes, preferably from 15 seconds to 1 minute and 15 seconds, and more preferably from 18 seconds to 60 seconds. Although the less amount of replenishing is the better, an amount of replenishing in the range from 2.5 mL to 50 mL per 1 roll for 24 exposures is adequate, preferably from 3 mL to 25 mL, and more preferably from 4 mL to 12 mL.

In the blix process of a color reversal film, a processing temperature is in the range from 30° C. to 45° C., preferably from 33° C. to 40° C., and more preferably from 37° C. to 39° C. A blix time is in the range from 4 minutes to 8 minutes, preferably from 5 minutes to 7 minutes, and more preferably from 5 minutes and 30 seconds to 6 minutes and 30 seconds. Although the less amount of replenishing is the better, an amount of replenishing in the range from 160 mL to 400 mL per 1 $m^2$ of the photosensitive material is adequate, preferably from 180 mL to 300 mL, and more preferably from 200 mL to 250 mL.

A fixing agent to be used in the blix composition or in the fix composition of the invention is a known fixing agent, namely, a water-soluble silver halide-dissolving agent like a thiosulfate such as sodium thiosulfate or ammonium thiosulfate, a thiocyanate such as sodium thiocyanate or ammonium thiocyanate, ethylene bis glycolic acid, 3,6-dithia-1,8-octanediol, thio ether compounds described in Japanese Patent Laid-Open No. 317055/1992, thioureas, or meso-ionic compounds described in Japanese Patent Laid-Open Nos. 143757/1992 and 230749/1992. These compounds can be used as a single kind or as two or more kinds of compounds mixed in combination. A concentration of the fixing agent in the fix solution or in the blix solution is preferably in the range from 0.3 mol/L to 2 mol/L, and more preferably from 0.5 mol/L to 1.5 mol/L.

It is preferred to add a buffer agent to the blix composition or to the fix composition. For a preferable buffer agent, heterocyclic organic bases such as imidazole and dimethylimidazole, aminoalkylene sulfonic acids such as taurine, or dibasic acids such as succinic acid, maleic acid and malonic acid are mentioned. A pH value of the blix composition or of the fix composition is preferably in the range from 3 to 8, and more preferably from 4 to 7.

The blix composition and the fix composition of the invention preferably contain a compound that releases a sulfite ion as a preservative, namely, a sulfite, a bisulfite or a metabisulfite. It is preferred that these compounds are added as a potassium salt, a sodium salt or an ammonium salt. Further, it is also preferred that an arylsulfinic acid such as p-toluenesulfinic acid, m-carboxybenzenesulfinic acid and p-aminobenzenesulfinic acid is contained. These compounds are preferably contained in the use solution in an amount ranged from 0.02 mol/L to 1.0 mol/L. As a preservative in addition to those described in the above, ascorbic acid, carbonyl-bisulfite adduct or a carbonyl compound may be added.

To the blix composition and the fix composition of the invention, the following compounds may be added for improving image preservation: compounds to form a stable silver ion, namely, mercapto nitrogen-containing heterocyclic compounds such as mercaptotriazole, aminomercaptotriazole and N-methylmercaptoimidazole, or compounds to accelerate washing-out of a developing agent such as bis amidines and bis guanidines described in Japanese Patent Laid-Open No. 303185/1993 or monoamidines. In addition to the above, to the blix composition and the fix composition of the invention, polymers such as polyethylene glycol and polyvinylpyrrolidone, chelating agents, anti-foaming agents and fungicides may be added according to necessity.

In the blix process of a color print material, to which the invention is applied, a processing temperature, a blix time and an amount of replenishing are just as described in the above. In the fixing process of a color negative film, a processing temperature is in the range from 30° C. to 55° C., preferably from 35° C. to 50° C., and more preferably from 38° C. to 45° C. A bleaching time is in the range from 20 seconds to 2 minutes, preferably from 30 seconds to 1 minute and 40 seconds, and more preferably from 35 seconds to 1 minute and 20 seconds. Although the less amount of replenishing is the better, an amount of replenishing in the range from 4 mL to 60 mL per 1 roll foe 24 exposures is adequate, preferably from 5 mL to 40 mL, and more preferably from 6 mL to 30 mL.

In the fixing process of a color reversal film, a processing temperature is in the range from 30° C. to 45° C., preferably from 33° C. to 40° C., and more preferably from 37° C. to 39° C. A fixing time is in the range from 2 minutes to 6 minutes, preferably from 3 minutes to 5 minutes, and more preferably from 3 minutes and 30 seconds to 4 minutes and 30 seconds. Although the less amount of replenishing is the better, an amount of replenishing in the range from 800 mL to 2000 mL per 1 $m^2$ of the photosensitive material is adequate, preferably from 900 mL to 1500 mL, and more preferably from 1000 mL to 1250 mL.

To the washing composition and the stabilization composition of the invention, formalin, acetaldehyde, pyruvinaldehyde, formaldehyde-bisulfite adducts described in U.S. Pat. No. 4,921,778 or N-methylol compounds described in Japanese Patent Laid-Open No. 34889/1993 may be added for preventing color-fading of a dye and stain-formation caused by a residual magenta coupler. Further, an arylsulfinic acid such as p-toluenesulfinic acid, m-carboxybenzenesulfinic acid and p-aminobenzenesulfinic acid is preferably contained. Furthermore, a surfactant as a water-draining agent, a chelating agent as a hard water-softening agent, a buffer agent for adjusting a pH value, an anti-foaming agent, a fungicide and a germicide may be added according to necessity.

A pH value of the washing composition or of the stabilization composition is preferably in the range from 4 to 10, and more preferably from 5 to 8. Although a processing temperature can be set in a variety depending on a usage or on properties of a photosensitive material, it is generally in the range from 20° C. to 50° C., and preferably from 25° C. to 45° C.

A photographic element processed with the processing composition of the invention can contain a silver halide usually used in a photosensitive material, for example, any of silver chloride, silver bromide, silveriodobromide, silver chlorobromide, silver iodochloride and a mixture of them. In a mode, this photosensitive element is a silver chloride-rich element containing at least 50 mol % or more of chloride, and more preferably at least 90 mol % or more of chloride. For example, the silver chloride-rich element is often used for a color print photosensitive material.

In another mode, at least one kind of an emulsion is mainly silver bromide (at least 50 mol % of silver bromide). Most preferably, this photographic element has one or more kinds of color recordings, and each color recording has one or more kinds of silver bromide-rich emulsions. The photographic element processed in execution of the invention can be a single color element or a multi-color element. Further, to the photographic element, a magnetic recording layer known to public in the technical field of the industry can be incorporated.

Details of each photographic element are, for example, described in *Research Disclosure* (hereinafter abbreviated as RD). RD 17634, pp. 23 to 27, RD 18716, pp. 647 to 650, RD 307105, pp. 866 to 868, pp. 873 to 879, and RD 36544, pp. 501 to 541 can be cited. These relate to useful silver halide emulsions (a negative type or a positive type) and their preparation methods, various kinds of sensitizers, dye-forming couplers, image-dye stabilizers, dyes, ultraviolet light-absorbing agents, filters, binders, hardeners, plasticizers, lubricants, coating-aids, surfactants, static charge-preventing agents, matting agents, paper or film supports, or various image-forming methods using a color element to form a negative image or a positive image.

In case that the processing compositions of the invention are prepared processing agent compositions to be mixed, it is advantageous that the whole components contained in the use solution are comprised in one composition, namely, a one-part-structure. However, when it is not desirable that components make a contact one another in a long time in the color development composition or the blix composition, components may be separated into two or more liquid parts or solid parts or both of them to make a processing composition having a two-part-structure or a three-part-structure. Such structures of prepared processing agent compositions to be mixed are usually called as a 1-, 2- or 3-part-structure according to the naming by the International Standards ISO 5989. The processing compositions of the invention do not lose their effects and features of the invention through being separated into parts. Among them, the 1-part-structure is particularly preferable for the color development composition.

For a container of the processing composition of the invention, a known material in accordance with the content can be used. The container may be made of a single material or a composite material, for example, a composite material comprising a material of high gas permeability and a material of high stability against alkali. In viewpoint of reusability and recyclability, it is preferred that the container is structured with a single raw material. Examples of the material to be used for the container include a polyester resin, a polyolefin resin, an acryl resin, an ABS resin, an epoxy resin, a polyamide resin such as Nylon, a polyurethane resin, a polystyrene resin, a polycarbonate resin, PVA, polyvinyl chloride, polyvinylidene chloride and a polyethylene resin. Among them, a container made of a polyester resin such as polyethylene terephthalate or polyethylene naphthalate or of a polyolefin resin such as polyethylene or polypropylene as a single material is preferable. A polyethylene resin is more preferable and a high density type polyethylene resin (HDPE) is furthermore preferable as a material for the container.

Into the material for the container to be used in the invention, carbon black, titanium white, a pigment, calcium carbonate or a plasticizer having compatibility with the material can be incorporated, as far as it gives no influence to the processing composition. A material having a polyethylene content ratio of 85% or more and containing no plasticizer is preferred for the material of the container. A material having a polyethylene content ratio of 95% or more and containing no plasticizer is furthermore preferred.

A shape and a structure of the container to be charged with the processing composition of the invention can optionally be designed according to the purpose. In addition to a standard-shaped bottle, expansion and contraction-flexible type containers described in Japanese Patent Laid-Open No. 235950/1989 and containers with a flexible partition described in Japanese Patent Laid-Open No. 134626/1987 can also be used. Containers described in Japanese Patent Laid-Open No. 282148/1999 are particularly preferable for the container of the processing composition of the invention from viewpoints of capacity, space efficiency, self-standing ability, shape-keeping capability and reuse or recycle. A preferable mode is a kit in which a plurality of the processing compositions of the invention are each charged in containers made of a single component material and having the same shape and volume, and further these containers are inserted in a single cartridge. As an example of the cartridge, cartridges described in Japanese Patent Laid-Open No. 3014/2000 can be cited. Cartridges described in Japanese Patent Laid-open Nos. 295858/1999 and 288068/1999 are preferable modes in which a development composition, a bleach composition and a fix composition are put in.

Modes and effects of the present invention will be explained in more detail with EXAMPLES hereinafter. However, the invention is not construed as being limited thereto.

EXAMPLE 1

As shown in the following, a prepared processing agent in a condensed liquid form for color development was prepared and its stability was tested.

(1) Preparation of Color Development Composition

A compound represented by Formula (I) of the invention

Refer to TABLE 1

A compound represented by Formula (II) of the invention

Refer to TABLE 1

| | |
|---|---|
| Tri(isopropanol)amine | 40.0 g |
| Ethylenediamine tetra(acetic acid) | 15.0 g |
| Sodium sulfite | 0.80 g |
| Sodium 4,5-dihydroxybenzene-1,3-disulfonate | 2.0 g |
| Disodium-N,N-bis(sulfonatethyl)hydroxylamine | 55.0 g |
| 4-amino-3-methyl-N-ethyl-N-(β-methanesulfonamideethyl)aniline 3/2 sulfate monohydrate | 70.0 g |
| Potassium hydroxide | 34.5 g |
| Sodium hydroxide | 25.0 g |
| Potassium carbonate | 100.0 g |
| Water to make | 1000 mL |
| pH | 13.2 |

(2) Evaluation

Stability against deposit segregation of the condensed processing composition described in the above was evaluated by a method described below.

The prepared color development composition was charged in a glass bottle and stored during four weeks at −5° C. and at a room temperature. The test results were evaluated by visual measurement of the liquid condition after storage according to five-step-evaluation as follows: a level with remarkable deposit was expressed as XX; a level with distinct deposit was expressed as X; a level with slight deposit was expressed as Δ; a level without deposit but with a turbidity was expressed as O; and a clear level without both of deposit and a turbidity pressed as OO.

TABLE 1

| Sample | Compound represented by Formula (I) | Addition Amount mmol | Compound represented by Formula (II) | Addition Amount mmol | Evaluation of Segregation (−5° C.) | Evaluation of Segregation (room temp.) | Note |
|---|---|---|---|---|---|---|---|
| 1 | — | — | — | — | XX | X | Comp |
| 2 | — | — | S-3 | 35 | X | X | Comp |
| 3 | P-1 | 25 | — | — | Δ | Δ | Comp |
| 4 | P-1 | 10 | S-3 | 35 | ○ | ○○ | Inv |
| 5 | P-1 | 25 | S-3 | 35 | ○○ | ○○ | Inv |
| 6 | P-1 | 25 | S-4 | 35 | ○○ | ○○ | Inv |
| 7 | P-1 | 25 | S-6 | 35 | ○ | ○○ | Inv |
| 8 | P-1 | 25 | S-7 | 35 | ○ | ○○ | Inv |
| 9 | P-2 | 25 | S-3 | 35 | ○○ | ○○ | Inv |
| 10 | P-3 | 25 | S-3 | 35 | ○○ | ○○ | Inv |
| 11 | P-9 | 25 | S-3 | 35 | ○○ | ○○ | Inv |
| 12 | P-10 | 25 | S-3 | 35 | ○ | ○○ | Inv |

Inv: The Present Invention
Comp: Comparative Example (3) Results

In the composition without both of a compound represented by Formula (I) and a compound represented by Formula (II), occurred needle like crystals considered as free bases of developing agent. Similar crystals were observed in the composition using either of compounds. Nevertheless, the compounds using both of a compound represented by Formula (I) and a compound represented by Formula (II) did not form any needle-like crystals to show that developing agents were dissolved in a stabilized condition.

EXAMPLE 2

By using the composition of Sample 5 in EXAMPLE 1, the following photosensitive material sample was continuously processed.

(1) Preparation of Photosensitive Material Sample

After a corona discharge treatment was performed on the surface of a support comprising both surfaces of paper coated with a polyethylene resin, a gelatin undercoat layer containing sodium dodecylbenzene sulfonate was provided on the support, and further, layers from the first layer to the seventh layer were coated in order, thereby a silver halide color photographic photosensitive material P-1 having the layer constitution shown below was prepared. The coating solutions for each photographic constitution layer were prepared as follows.

Preparation of Fifth Layer Coating Solutions 300 g of Cyan Coupler (ExC-1), 250 g of Color Image Stabilizer (Cpd-1), 10 g of Color Image Stabilizer (Cpd-9), 10 g of Color Image Stabilizer (Cpd-10), Color Image Stabilizer (Cpr-12), 14 g of Ultraviolet Light Absorber (UV-1), 50 g of Ultraviolet Light Absorber (UV-2), 40 g of Ultraviolet Light Absorber (UV-3) and 60 g of Ultraviolet Light Absorber (UV-4) were dissolved in 230 g of Solvent (Solv-6) and 350 mL of ethyl acetate. This solution was emulsion-dispersed into 6500 g of a 10% gelatin aqueous solution containing 25 g of sodium dodecylbenzenesulfonate, thereby Emulsified Dispersion C was prepared.

On the other hand, Silver Chlorobromide Emulsion C [cubic grains; a 5:5 mixture (molar ratio in terms of silver) of Large Grain Emulsion C having an average grain size of 0.40 $\mu$m and Small Grain Emulsion C having an average grain size of 0.30 $\mu$m; variation coefficients of grain size distribution were 0.09 and 0.11 respectively; in both emulsions, silver bromide of 0.5 mol % was localized on apart of grain surface fundamentally made of silver chloride] was prepared, In this emulsion, red sensitive Sensitizing Dye G and Sensitizing Dye H were respectively added to Large Grain Emulsion C in an amount of $9.0\times10^{-5}$ mol per 1 mol of silver and to Small Grain Emulsion C in an amount of $12.0\times10^{-5}$ mol per 1 mol of silver. Further, chemical sensitization for this emulsion was optimally performed with addition of a sulfur sensitizer and a gold sensitizer.

Emulsified Dispersion C and Silver Chlorobromide Emulsion C described in the above were mixed and dissolved to obtain the composition described below, thereby Fifth Layer Coating Solution was prepared. A coated amount of emulsion was expressed in a coated amount calculated in terms of silver.

First Layer to Fourth Layer Coating Solutions and Sixth Layer to Seventh Layer Coating Solutions were prepared in the same manner as that in Fifth Layer Coating Solution. As a hardener for gelatin in each layer, sodium salt of 1-oxy-3, 5-dichloro-s-triazine was used. Further, to each layer, Preservative (Ab-1), (Ab-2), (Ab-3) and (Ab-4) were added so as to obtain an entire amount of 15.0 mg/m$^2$, 60.0 mg/m$^2$, 5.0 Mg/m$^2$ and 10.0 mg/m$^2$ respectively Preservative (Ab-1)

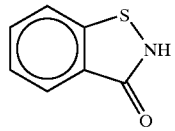

Preservative (Ab-2)

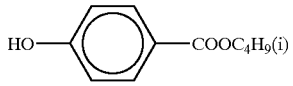

Preservative (Ab-3)

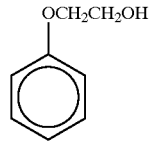

Preservative (Ab-4)

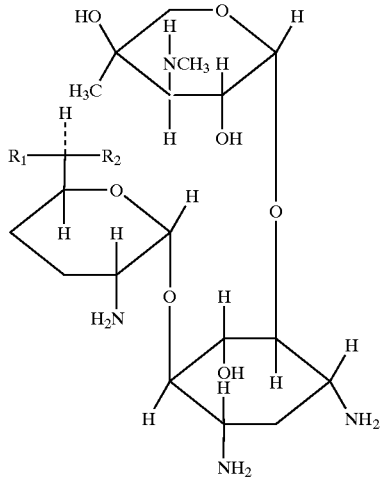

| | $R_1$ | $R_2$ |
|---|---|---|
| a | —$CH_3$ | —$NHCH_3$ |
| b | —$CH_3$ | —$NH_2$ |
| c | —H | —$NH_2$ |
| d | —H | —$NHCH_3$ |

A mixture of a, b, c and d = 1:1:1:1 (molar ratio)

To the silver chlorobromide emulsion in each photosensitive emulsion layer, spectral sensitizing dyes indicated below were respectively used.

Blue Sensitive Emulsion Layer

Sensitizing Dye A

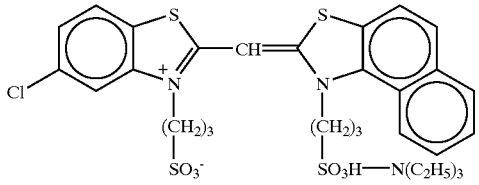

-continued

Sensitizing Dye B

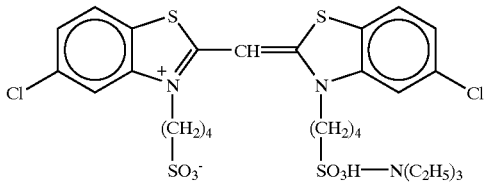

Sensitizing Dye C

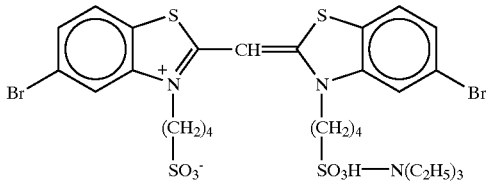

(Sensitizing Dye A and Sensitizing Dye C were added to the large grain emulsion in an amount of $0.42\times10^{-4}$ mol per 1 mol of silver halide and to the small grain emulsion in an amount of $0.50\times10^{-4}$ mol. Sensitizing Dye B was added to the large grain emulsion in an amount of $3.4\times10^{-4}$ mol per 1 mol of silver halide and to the small grain emulsion in an amount of $4.1\times10^{-4}$ mol.)

Green Sensitive Emulsion Layer

Sensitizing Dye D

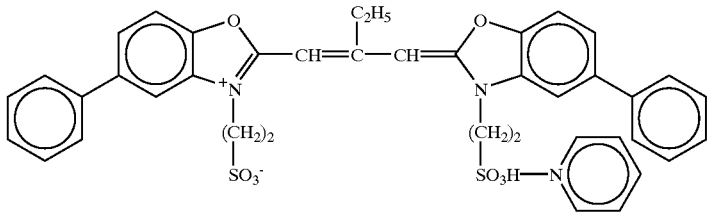

Sensitizing Dye E

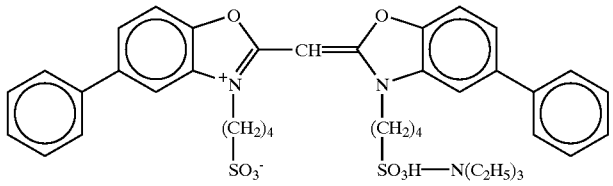

Sensitizing Dye F

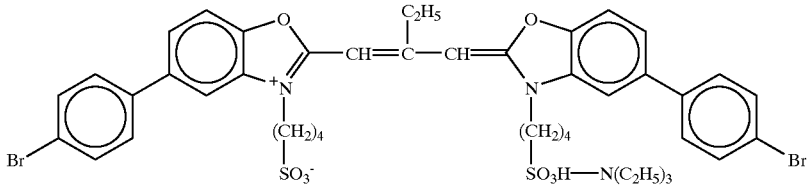

Sensitizing Dye D was added to the large grain emulsion in an amount of $3.0\times10^{-4}$ mol per 1 mol of silver halide and to the small grain emulsion in an amount of $3.6\times10^{-4}$ mol. Sensitizing Dye E was added to the large grain emulsion in an amount of $4.0\times10^{-4}$ mol per 1 mol of silver halide and to the small grain emulsion in an amount of $7.0\times10^{-4}$ mol. Further, Sensitizing Dye F was added to the large grain emulsion in an amount of $2.0\times10^{-4}$ mol per 1 mol of silver halide and to the small grain emulsion in an amount of $2.8\times10^{-4}$ mol.)

Red Sensitive Emulsion Layer

Sensitizing Dye G

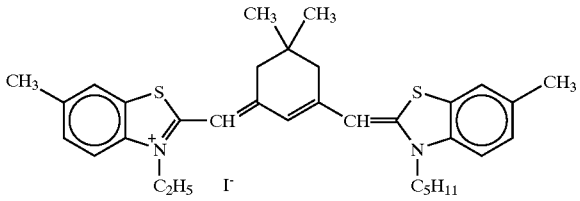

Sensitizing Dye H

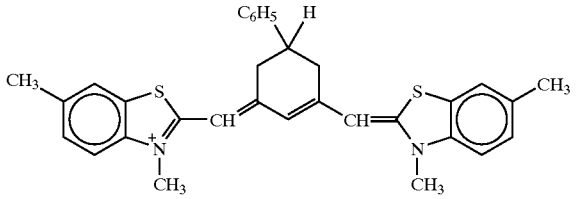

-continued

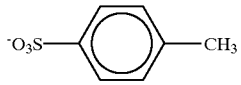

Sensitizing Dye C and Sensitizing Dye H were added to the large grain emulsion in an amount of $8.0\times10^{-5}$ mol per 1 mol of silver halide and to the small grain emulsion in an amount of $10.7\times10^{-5}$ mol. Further, Compound I indicated below was added to the red sensitive emulsion layer in an amount of $3.0\times10^{-3}$ mol per 1 mol of silver halide.)

Compound I

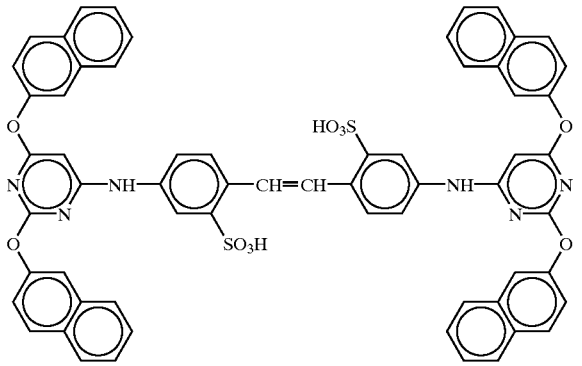

To the blue sensitive emulsion layer, the green sensitive emulsion layer and the red sensitive emulsion layer, 1-(3methylureidophenyl)-5-mercaptotetrazole was added respectively in an amount of $3.3\times10^{-4}$ mol, $1.0\times10^{-3}$ mol and $5.9\times10^{-4}$ mol per 1 mol of silver halide.

To the second layer, the fourth layer, the sixth layer and the seventh layer, 1-(3-methylureidophenyl)-5-mercaptotetrazole was added respectively in an amount of 0.2 mg/m$^2$, 0.2 mg/m$^2$, 0.6 mg/m$^2$ and 0.1 mg/m$^2$.

To the blue sensitive emulsion layer and the green sensitive emulsion layer, 4-hydroxy-6-methyl-1,3,3a,7-tetrazaindene was added respectively in an amount of $1\times10^{-4}$ mol and $2\times10^{-4}$ mol per 1 mol of silver halide.

To the red sensitive emulsion layer, a latex of a methacrylic acid/butyl acrylate copolymer (1:1 by weight ratio; average molecular weight: 200,000 to 400,0001 was added in an amount of 0.05 g/m$^2$.

To the second layer, the fourth layer and the sixth layer, disodium catechol-3,5-disulfonate was added respectively in an amount of 6 mg/m$^2$, 6 mg/m$^2$ and 18 mg/m$^2$.

In order to prevent irradiation, dyes indicated below (a coated amount shown in a parenthesis) were added.

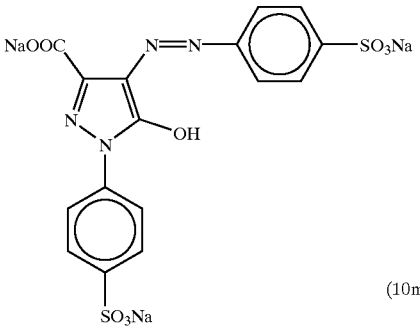

(10mg/m2)

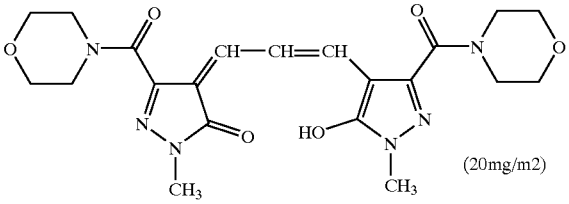

(20mg/m2)

-continued

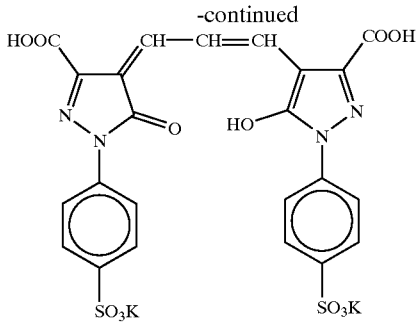

(5mg/m2)

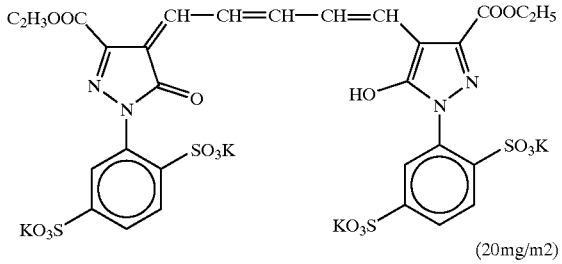

(20mg/m2)

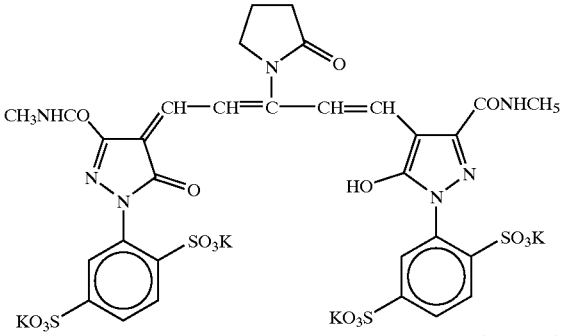

(20mg/m2)

Layer Constitution

The constitution of each layer will be described hereinafter. Numerals indicate a coated amount (g/m$^2$). In case of a silver halide emulsion, numerals indicate a coated amount calculated in terms of silver.

Support

Polyethylene Resin-Laminated Paper

The polyethylene resin on the first layer side contains a white pigment ($TiO_2$: a content ratio of 16 wt %, ZnO: a content ratio of 4 wt %), a fluorescent whitening agent [4, 4'-bis (5-methylbenzoxazolyl) stilbene: a content ratio of 0.03 wt %] and a bluing dye (ultramarine)

First Layer (Blue Sensitive Emulsion Layer):

| | |
|---|---|
| Silver Chlorobromide Emulsion A [cubic grains; a 5:5 (silver molar ratio) mixture of Large Grain Emulsion A having an average grain size of 0.74 μm and Small Grain Emulsion A having an average grain size of 0.65 μm; variation coefficients of grain size distribution were 0.08 and 0.10 respectively; both emulsions were incorporated with silver bromide of 0.3 mol % localized on a part of grain surface fundamentally made of silver chloride] | 0.24 |
| Gelatin | 1.25 |
| Yellow Coupler (ExY) | 0.57 |

-continued

| | |
|---|---|
| Color Image Stabilizer (Cpd-1) | 0.07 |
| Color Image Stabilizer (Cpd-2) | 0.04 |
| Color Image Stabilizer (Cpd-3) | 0.07 |
| Solvent (Solv-1) | 0.21 |
| **Second Layer (Color Blend-Preventing Layer):** | |
| Gelatin | 0.99 |
| Color Blend-Preventing Agent (Cpd-4) | 0.09 |
| Color Blend-Preventing Aid (Cpd-5) | 0.018 |
| Stabilizer (Cpd-6) | 0.13 |
| Color Blend-Preventing Agent (Cpd-7) | 0.01 |
| Solvent (Solv-1) | 0.06 |
| Solvent (Solv-2) | 0.22 |
| **Third Layer (Green Sensitive Emulsion Layer):** | |
| Silver Chlorobromide Emulsion B [cubic grains; a 1:3 (silver molar ratio) mixture of Large Grain Emulsion B having an average grain size of 0.45 μm and Small Grain Emulsion B having an average grain size of 0.35 μm; variation coefficients of grain size distribution were 0.10 and 0.08 respectively; both emulsions were incorporated with silver bromide of 0.4 mol % localized on a part of grain surface fundamentally made of silver chloride] | 0.14 |
| Gelatin | 1.36 |
| Magenta Coupler (ExM) | 0.15 |
| Ultraviolet Light Absorber (UV-1) | 0.05 |
| Ultraviolet Light Absorber (UV-2) | 0.03 |
| Ultraviolet Light Absorber (UV-3) | 0.02 |
| Ultraviolet Light Absorber (UV-4) | 0.04 |
| Color Image Stabilizer (Cpd-2) | 0.02 |
| Color Blend-Preventing Agent (Cpd-4) | 0.002 |
| Stabilizer (Cpd-6) | 0.09 |
| Color Image Stabilizer (Cpd-8) | 0.02 |
| Color Image Stabilizer (Cpd-9) | 0.03 |
| Color Image Stabilizer (Cpd-10) | 0.01 |
| Color Image Stabilizer (Cpd-11) | 0.0001 |
| Solvent (Solv-3) | 0.11 |
| Solvent (Solv-4) | 0.22 |
| Solvent (Solv-5) | 0.20 |
| **Fourth Layer (Color Blend-Preventing Layer):** | |
| Gelatin | 0.71 |
| Color Blend-Preventing Agent (Cpd-4) | 0.06 |
| Color Blend-Preventing Aid (Cpd-5) | 0.013 |
| Stabilizer (Cpd-6) | 0.10 |
| Color Blend-Preventing Agent (Cpd-7) | 0.007 |
| Solvent (Solv-1) | 0.04 |
| Solvent (Solv-2) | 0.16 |
| **Fifth Layer (Red Sensitive Emulsion Layer):** | |
| Silver Chlorobromide Emulsion C [cubic grains; a 5:5 (silver molar ratio) mixture of Large Grain Emulsion C having an average grain size of 0.40 μm and Small Grain Emulsion C having an average grain size of 0.30 μm; variation coefficients of grain size distribution were 0.09 and 0.11 respectively; both emulsions were incorporated with silver bromide of 0.5 mol % localized on a part of grain surface fundamentally made of silver chloride] | 0.20 |
| Gelatin | 1.11 |
| Cyan Coupler (ExC-1) | 0.15 |
| Cyan Coupler (ExC-2) | 0.10 |
| Color Image Stabilizer (Cpd-1) | 0.25 |
| Color Image Stabilizer (Cpd-14) | 0.03 |
| Color Image Stabilizer (Cpd-15) | 0.10 |
| Color Image Stabilizer (Cpd-16) | 0.08 |
| Color Image Stabilizer (Cpd-17) | 0.05 |
| Color Image Stabilizer (Cpd-18) | 0.01 |
| Solvent (Solv-5) | 0.23 |
| **Sixth Layer (Ultraviolet Light-Absorbing Layer):** | |
| Gelatin | 0.46 |
| Ultraviolet Light Absorber (UV-1) | 0.14 |
| Ultraviolet Light Absorber (UV-2) | 0.05 |
| Ultraviolet Light Absorber (UV-3) | 0.04 |
| Ultraviolet Light Absorber (UV-4) | 0.06 |
| Solvent (Solv-7) | 0.25 |

-continued

| | |
|---|---|
| **Seventh Layer (Protective Layer):** | |
| Gelatin | 1.00 |
| Acryl-modified copolymer of polyvinyl alcohol (degree of modification: 17%) | 0.04 |
| Liquid paraffin | 0.02 |
| Surfactant (Cpd-13) | 0.01 |

Yellow Coupler (ExY)

A 60:40 (molar ratio) mixture of

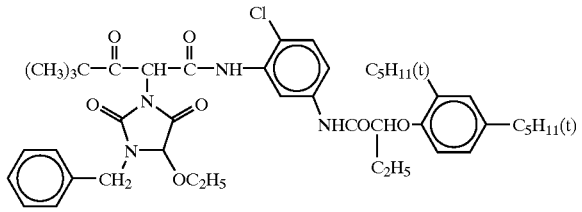

and

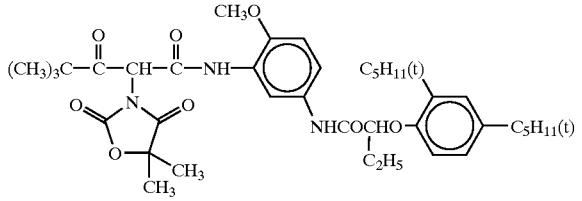

Magenta Coupler (ExM)

A 60:40 (molar ratio) mixture of

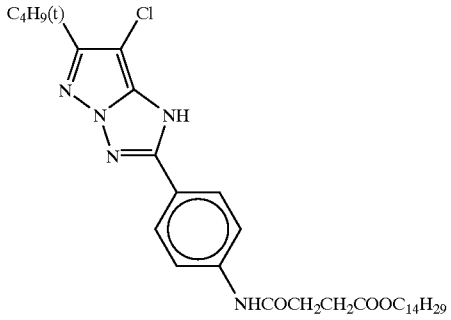

and

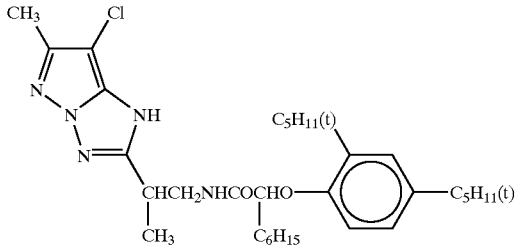

Color Image Stabilizer (Cpd-1)

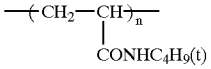

Number average molecular weight: 60,000

-continued

Color Image Stabilizer (Cpd-2)

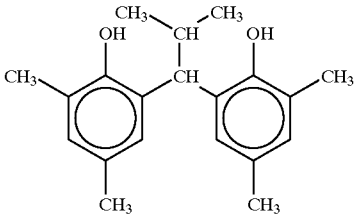

Color Image Stabilizer (Cpd-3)

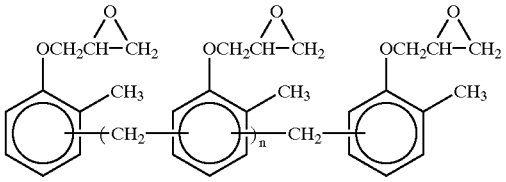

n = 7 to 8 (mean value)

Color Blend-Preventing Agent (Cpd-4)

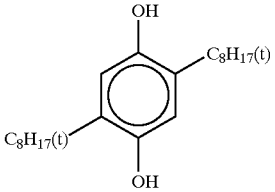

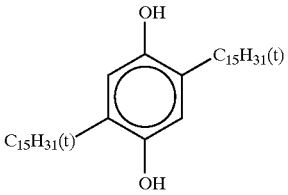

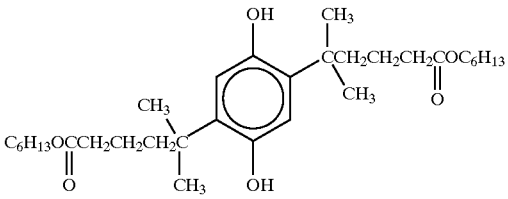

A1:1:1 (molar ratio) mixture of the above three compounds

Color Blend-Preventing Aid (Cpd-5)

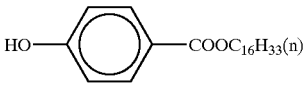

Stabilizer (Cpd-6)

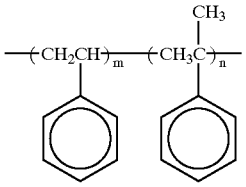

Number average molecular weight: 600
m/n = 10/90

-continued

Color Blend-Preventing Agent (Cpd-7)

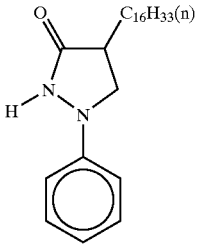

Color Image Stabilizer (Cpd-8)

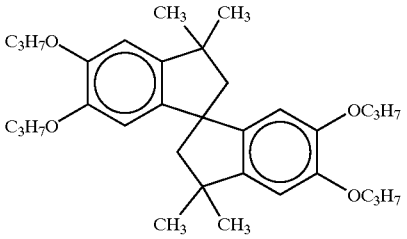

Color Image Stabilizer (Cpd-9)

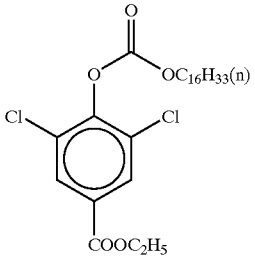

Color Image Stabilizer (Cpd-10)

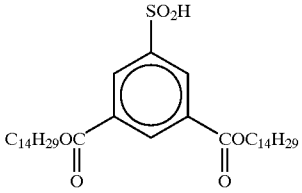

(Cpd-11)

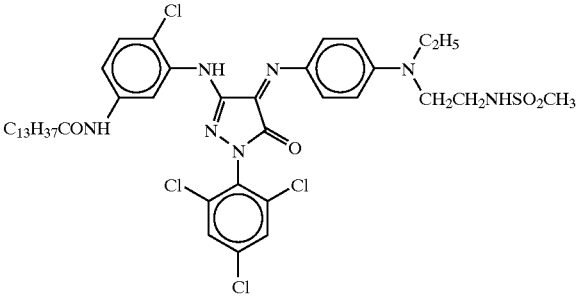

Color Image Stabilizer (Cpd-12)

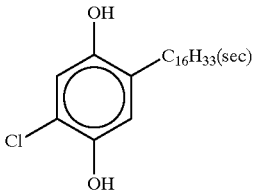

-continued
Surfactant (Cpd-13)
A 7:3 mixture (molar ratio) of
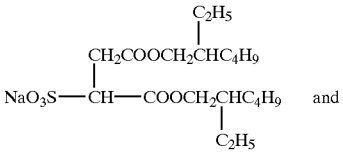
and
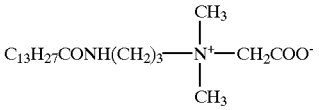
(Cpd-14)
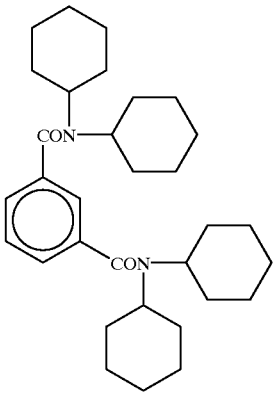
(Cpd-15)
A 1:1 (molar ratio) mixture of
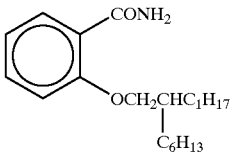
and
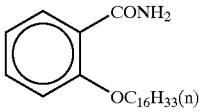
(Cpd-16)
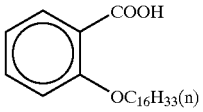
(Cpd-17)
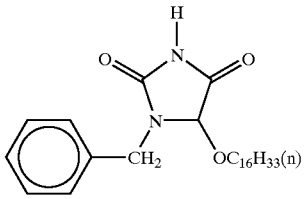
(Cpd-18)
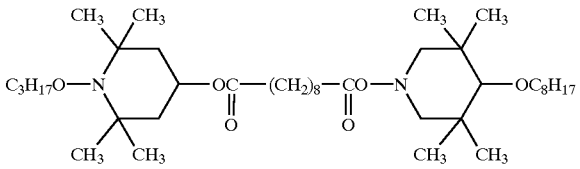
-continued
Ultraviolet Light Absorber (UV-1)
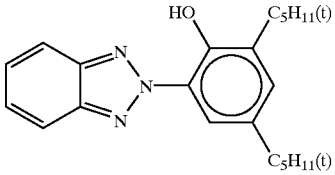
Ultraviolet Light Absorber (UV-2)
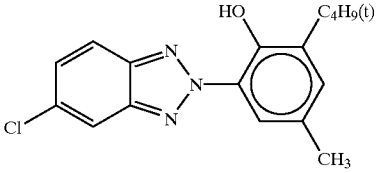
Ultraviolet Light Absorber (UV-3)
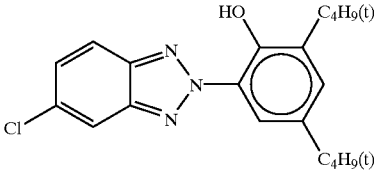
Ultraviolet Light Absorber (UV-4)
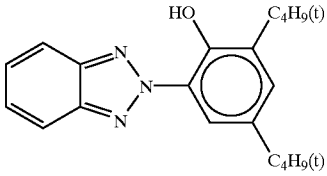
Ultraviolet Light Absorber (UV-5)
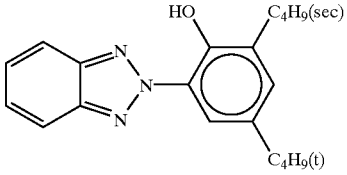
(Solv-1)
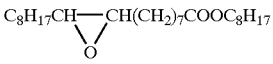
(Solv-2)
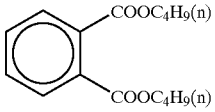
(Solv-3)
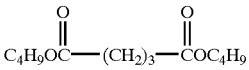
(Solv-4)
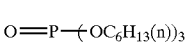
(Solv-5)
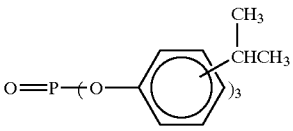

-continued (Solv-6)

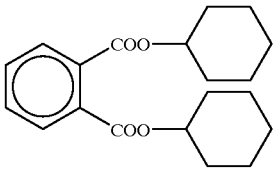

(Solv-7)

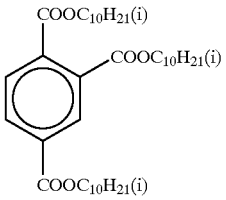

(Solv-8)

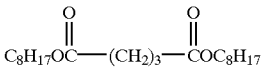

(Solv-9)

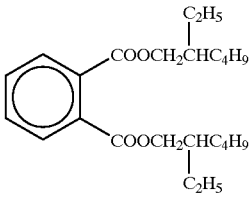

(2) Development Processing

The photosensitive material sample described in the above was processed into a roll-form of 127 mm in width. An experimental processing unit was used, which was a remodeling of a printer processor for a mini-laboratory UCO, Model PP350, manufactured by Fuji Photo Film Co., Ltd. so as to enable both of a processing time and a processing temperature to be changed. After being image-wise exposed to light through a negative film of an average density, the photosensitive material sample was treated in a continuous processing (a running test) until replenishing had been done in a twice volume as much as a color development tank in the processing processes described below.

| Processing Process | Temperature | Time | Replenishing Volume* |
|---|---|---|---|
| Color Development | 45.0° C. | 25 sec | 45 mL |
| Blix | 40.0° C. | 25 sec | 35 mL |
| Rinse (1) | 40.0° C. | 8 sec | — |
| Rinse (2) | 40.0° C. | 8 sec | — |
| Rinse (3)** | 40.0° C. | 8 sec | — |
| Rinse (4)** | 38.0° C. | 8 sec | 150 mL |
| Drying | 80° C. | 15 sec | |

*A replenishing volume per 1 $m^2$ of a photosensitive material

**A rinse-cleaning system RC50D manufactured by Fuji Photo Film Co., Ltd. was installed in Rinse (3). A replenishing solution was taken out of Rinse (3) and sent to a reverse osmosis module (RC50D) by means of a pump. Permeated water obtained in the tank was supplied to Rinse (4) and condensed water was returned to Rinse (3). A pump pressure was adjusted to keep a volume of permeated water in the range from 50 mL/min to 300 mL/min. Circulation under temperature control was conducted for 10 hours a day. Rinse processes were arranged in a countercurrent system through four tanks from (1) to (4).

The composition of each processing solution is described as follows.

| [Color Developer] | [Solution in Tank] |
|---|---|
| Water | 800 mL |
| P-1 | 4 mmol |
| S-1 | 5 mmol |
| Tri(isopropanol)amine | 8.8 g |
| Ethylenediamine tetra(acetic acid) | 4.0 g |
| Sodium sulfite | 0.10 g |
| Potassium chloride | 10.0 g |
| Sodium 4,5-dihydroxybenzene-1,3-disulfonate | 0.5 g |
| Disodium-N,N-bis(sulfonatethyl)hydroxylamine | 8.5 g |
| 4-amino-3-methyl-N-ethyl-N-(β-methanesulfonamide ethyl)aniline 3/2 sulfuric acid monohydrate | 7.0 g |
| Potassium carbonate | 26.3 g |
| Water to make | 1000 mL |
| pH (adjusted by sulfuric acid and potassium hydroxide at 25° C.) | 10.35 |

For a color development replenishing solution, a solution obtained by diluting Sample 5 in EXAMPLE 1 with water by 3.8 times was used.

| [Blix Solution] | [Solution in Tank] | [Replenishing solution] |
|---|---|---|
| Water | 800 mL | 800 mL |
| Ammonium thiosulfate (750 g/mL) | 107 mL | 214 mL |
| Succinic acid | 29.5 g | 59.0 g |
| Ammonium iron (III) ethylenediamine tetra (acetate) | 47.0 g | 94.0 g |
| Ethylenediamine tetra (acetic acid) | 1.4 g | 2.8 g |
| Nitric acid (67%) | 17.5 g | 35.0 g |
| Imidazole | 14.6 g | 29.2 g |
| Ammonium sulfite | 16.0 g | 32.0 g |
| Ammonium metabisulfite | 23.1 g | 46.2 g |
| Water to make | 1000 mL | 1000 mL |
| pH (adjusted by nitric acid and ammonia at 25° C.) | 6.00 | 6.00 |

| [Rinse Solution] | [Solution in Tank] | [Replenishing Solution] |
|---|---|---|
| Sodium chloroisocyanurate | 0.02 g | 0.02 g |
| Deionized water (electric conductivity: 5 μs/cm or less) | 1000 mL | 1000 mL |
| pH (25° C.) | 6.5 | 6.5 |

(3) Results of Evaluation

Stain, gradation and color reproducibility were evaluated as photographic properties. Each property was good and the conditions of the developing solution and of the development replenishing solution were normal.

Comparative Examples

Comparative Example 1

In COMPARATIVE EXAMPLE 1, conditions and operations were conducted in the same manner as those in EXAMPLE 2, except that P-1 and S-1 were not added in the color development solution. An obtained processed sample showed dense residual colors to cause stain which produced soft gradation in a highlight area and also poor color reproducibility because of brownish overcast of residual colors.

Comparative Example 2

In COMPARATIVE EXAMPLE 2, conditions and operations were conducted in the same manner as those in EXAMPLE 2, except that P-1 was not added in the color development solution. An obtained processed sample showed remarkable improvement compared to the sample without both of P-1 and S-1 in Comparative Example 1 described in the above, but still had heavy stain to result in clearly worse image quality in comparison with that of the sample in EXAMPLE 2.

Comparative Example 3

In COMPARATIVE EXAMPLE 3, conditions and operations were conducted in the same manner as those in EXAMPLE 2, except that S-1 was not added in the color development solution. An obtained processed sample showed remarkable improvement compared to the sample without both of P-1 and S-1 in Comparative Example 1 described in the above, but still had a brownish white area due to stain caused by residual colors to result in clearly worse image quality in comparison with that of the sample in EXAMPLE 2.

Comparative Example 4

In COMPARATIVE EXAMPLE 4, conditions and operations were conducted in the same manner as those in EXAMPLE 2, except that P-1 was not added in the color development solution and the addition amount of S-1 was doubled in place of P-1. In spite of the increased amount of S-1, a stain level of an obtained processed sample was not equivalent to the level of the sample in EXAMPLE 2. Furthermore, the obtained sample showed a density decrease in a shadow area to result in worse image quality with vagueness.

In comparative examples described in the above, the following facts are indicated. When the processing of the invention in which an optimum amount of a compound represented by Formula (I) and an optimum amount of a compound represented by Formula (II) are respectively selected and used in combination is performed, residual colors of dyes are diminished for reducing stain, for producing steeper gradation in a highlight area, and for maintaining a high level of density in a shadow area. On the contrary, when either one of a compound represented by Formula (I) or a compound represented by Formula (II) is added, even if its addition amount is adjusted, compatibility of stain reduction and gradation keeping up to a high density level is hardly achieved.

EXAMPLE 3

In this EXAMPLE 3, the photosensitive material and the processing are changed to show an example in which prepared processing agents are made and a processing solution is prepared with the prepared processing agents to conduct processing.

(1) Preparation of Color Development Composition

| | |
|---|---|
| P-1 | 15 mmol |
| S-1 | 20 mmol |
| Tri(isopropanol)amine | 34.0 g |
| Ethylenediamine tetra(acetic acid) | 15.0 g |
| Sodium sulfite | 0.80 g |
| Sodium 4,5-dihydroxybenzene-1,3-disulfonate | 2.0 g |
| Disodium-N,N-bis(sulfonatethyl)hydroxylamine | 55.0 g |
| 4-amino-3-methyl-N-ethyl-N-(β-methanesulfonamide ethyl)aniline 3/2 sulfuric acid monohydrate | 55.0 g |
| Potassium hydroxide | 19.0 g |
| Sodium hydroxide | 24.0 g |
| Potassium carbonate | 100.0 g |
| Water to make | 1000 ml |
| pH | 13.2 |

(2) Development Processing

The photosensitive material sample described in the above was processed into a roll-form of 127 mm in width. By using a printer-processor for a mini-laboratory use, Model PP350, manufactured by Fuji Photo Film Co., Ltd., after being imagewise exposed to light through a negative film of an average density, the photosensitive material sample was treated in a continuous processing (a running test) until a volume of used color development replenishing solution had reached a 0.5 times volume as much as a color development tank in the processing processes described below.

| Processing Process | Temperature | Time | Replenishing Volume* |
|---|---|---|---|
| Color Development | 38.5° C. | 45 sec | 45 mL |
| Blix | 38.0° C. | 45 sec | 35 mL |
| Rinse (1) | 38.0° C. | 20 sec | — |
| Rinse (2) | 38.0° C. | 20 sec | — |
| Rinse (3)** | 38.0° C. | 20 sec | — |
| Rinse (4)** | 38.0° C. | 20 sec | 121 mL |
| Drying | 80° C. | | |

*A replenishing volume per 1 $m^2$ of a photosensitive material

**A rinse-cleaning system RC50D manufactured by Fuji Photo Film Co., Ltd. was installed in Rinse (3). A replenishing solution was taken out of Rinse (3) and sent to a reverse osmosis module (RC50D) by means of a pump. Permeated water obtained in the tank was supplied to Rinse (4) and condensed water was returned to Rinse (3). A pump pressure was adjusted to keep a volume of permeated water in the range from 50 mL/min to 300 mL/min. Circulation under temperature control was conducted for 10 hours a day. Rinse processes were arranged in a countercurrent system through four tanks from (1) to (4).

The composition of each processing solution is described as follows.

| [Color Developer] | [Solution in Tank] |
|---|---|
| Water | 800 mL |
| P-1 | 2 mmol |
| S-3 | 2 mmol |
| Tri(isopropanol)amine | 8.8 g |
| Polyethylene glycol (average molecular weight: 300) | 10.0 g |
| Ethylenediamine tetra(acetic acid) | 4.0 g |
| Sodium sulfite | 0.10 g |
| Potassium chloride | 10.0 g |
| Sodium 4,5-dihydroxybenzene-1,3-disulfonate | 0.50 g |
| Disodium-N,N-bis(sulfonatethyl)hydroxylamine | 8.5 g |
| 4-amino-3-methyl-N-ethyl-N-(β-methanesulfonamide ethyl)aniline 3/2 sulfuric acid monohydrate | 4.8 g |
| Potassium carbonate | 26.3 g |

-continued

| [Color Developer] | [Solution in Tank] |
|---|---|
| Water to make | 1000 mL |
| pH (adjusted by sulfuric acid and potassium hydroxide at 25° C.) | 10.15 |

For a color development replenishing solution, a solution obtained by diluting the color development composition prepared in (1) by 3.8 times with water was used.

| [Blix Solution] | [Solution in Tank] | [Replenishing Solution] |
|---|---|---|
| Water | 800 mL | 800 mL |
| Ammonium thiosulfate (750 g/mL) | 107 mL | 214 mL |
| m-carboxybenzenesulfinic acid | 8.3 g | 16.5 g |
| Ammonium iron (III) ethylenediamine tetra(acetate) | 47.0 g | 94.0 g |
| Ethylenediamine tetra(acetic acid) | 1.4 g | 2.8 g |
| Nitric acid (67%) | 16.5 g | 33.0 g |
| Imidazole | 14.6 g | 29.2 g |
| Ammonium sulfite | 16.0 g | 32.0 g |
| Potassium metabisulfite | 23.1 g | 46.2 g |
| Water to make | 1000 mL | 1000 mL |
| pH (adjusted by nitric acid and ammonia water at 25° C.) | 6.5 | 6.5 |

| [Rinse Solution] | [Solution in Tank] | [Replenishing Solution] |
|---|---|---|
| Sodium chloroisocyanurate | 0.02 g | 0.02 g |
| Deionized water (electric conductivity; 5 μs/cm or less) | 1000 mL | 1000 mL |
| pH (25°0 C.) | 6.5 | 6.5 |

(3) Results of Evaluation

Stain, gradation and color reproducibility were evaluated as photographic properties in the same criteria and methods as those in EXAMPLE 2. Each property was good and the conditions of the developing solution and of the development replenishing solution were normal.

As described in detail in the above, the processing composition of the present invention for a silver halide color photographic photosensitive material, which contains a bis-triazinylarylenediomine derivative represented by Formula (I) and a diaminostilbene derivative represented by Formula (II), shows excellent effects. Namely, stain caused by residual dyes in the photosensitive material is reduced and no segregated deposit occurs even when the processing composition is stored at a low temperature. The image-formation process using the processing composition of the invention can achieve the same effects.

This application is based on Japanese patent application JP 2000-398271, filed Jul. 24, 2000, and JP 2001-026954, filed Feb. 2, 2001, the entire contents of each of which are hereby incorporated by reference, the same as if set forth at length.

What is claimed is:

1. A processing composition for a silver halide photographic photosensitive material, which comprises a compound represented by Formula (I) and a compound represented by Formula (II);

(I)

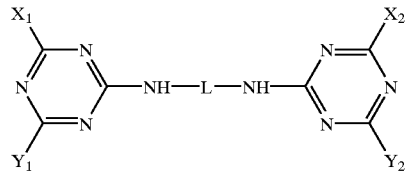

wherein $x_1$, $X_2$, $Y_1$ and $Y_2$ each independently represents a substituted or unsubstituted alkoxy group, a substituted or unsubstituted aryloxy group, a substituted or unsubstituted anilino group, a substituted or unsubstituted alkylamino group, a substituted or unsubstituted dialkylamino group, a substituted or unsubstituted nitrogen-containing heterocyclic group, a hydroxyl group, a hydroxy organic acid residue, an amino group, an amino acid residue, or a chloro group; and L represents a substituted or unsubstituted phenylene group or a substituted or unsubstituted naphthylene group, (II)

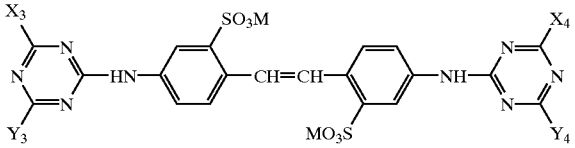

wherein $X_3$, $X_4$, $Y_3$ and $Y_4$ each independently represents a substituted or unsubstituted alkoxy group, a substituted or unsubstituted aryloxy group, a substituted or unsubstituted anilino group, a substituted or unsubstituted alkylamino group, a substituted or unsubstituted dialkylamino group, a substituted or unsubstituted nitrogen-containing heterocyclic group, a hydroxyl group, a hydroxyl organic acid residue, an amino group, an amino acid residue, and a chloro group; and M represents a hydrogen atom, an alkali metal, an alkali-earth metal, ammonium or pyridinium.

2. The processing composition for a silver halide photographic photosensitive material as claimed in claim 1, which is used in color development processing.

3. The processing composition for a silver halide photographic photosensitive material as claimed in claim 1, which is used in processing of a silver halide color print photosensitive material.

4. An image-formation process using the processing composition for a silver halide photographic photosensitive material as claimed in claim 1.

* * * * *